US011517065B2

(12) United States Patent
Wiart et al.

(10) Patent No.: US 11,517,065 B2
(45) **Date of Patent: *Dec. 6, 2022**

(54) PROTECTIVE HELMET WITH LINER ASSEMBLY

(71) Applicant: SPORT MASKA INC., Montreal (CA)

(72) Inventors: Nicole Jacqueline Wiart, Montreal (CA); Daniel Chartrand, Lorraine (CA); Maurice Dykmans, Montreal (CA); Philippe Martin, Chambly (CA); Simon-Pierre Germain, Granby (CA); Brian William Steenbrink, Pointe-Claire (CA); Pierre-Luc Beauchamp, Montreal (CA); Simon Langlois, Notre-Dame-de-l'Ile-Perrot (CA); Evangelos Spyrou, Montreal (CA)

(73) Assignee: SPORT MASKA INC, Montreal (CA)

( * ) Notice: Subject to any disclaimer, the term of this patent is extended or adjusted under 35 U.S.C. 154(b) by 468 days.

This patent is subject to a terminal disclaimer.

(21) Appl. No.: 16/577,008

(22) Filed: Sep. 20, 2019

(65) Prior Publication Data

US 2020/0008511 A1 Jan. 9, 2020

Related U.S. Application Data

(62) Division of application No. 15/464,947, filed on Mar. 21, 2017, now Pat. No. 10,455,884.

(51) Int. Cl.
*A42B 3/12* (2006.01)
*A63B 71/10* (2006.01)

(52) U.S. Cl.
CPC ..... *A42B 3/128* (2013.01); *A42B 3/127* (2013.01); *A63B 71/10* (2013.01)

(58) Field of Classification Search
CPC ..... A42B 3/128; A42B 3/125; A42B 3/127; A42B 3/124; A42B 3/12; A42B 3/063; A42B 3/064; A42B 3/066; A63B 71/10
See application file for complete search history.

(56) References Cited

U.S. PATENT DOCUMENTS 3,729,744 A * 5/1973 Rappleyea ..... A42B 3/28 2/420
4,006,496 A * 2/1977 Marker ..... A42B 3/128 2/414

(Continued)

FOREIGN PATENT DOCUMENTS

CA 2870578 10/2013
CA 2929623 6/2015

OTHER PUBLICATIONS

Bethany Rowson et al. Biomedical Engineering and Mechanics, Hockey STAR: A Methodology for Assessing the Biomechanical Performance of Hockey Helmets, vol. 43, No. 10, Oct. 2015.

*Primary Examiner* — Amy Vanatta
(74) *Attorney, Agent, or Firm* — Norton Rose Fulbright Canada

(57) ABSTRACT

A protective helmet including an outer shell, and a liner assembly received in the outer shell and connected to the outer shell, the liner assembly defining a front portion configured to overlay a front of a head of a wearer, a rear portion configured to overlay a rear of the head of the wearer, a top portion disposed above and out of contact with a top of the head of the wearer when the helmet is worn, and two opposed side portions each configured to overlay a respective side of the head of the wearer. Each of the front, rear, side and top portions includes at least one zone where the liner assembly includes a plurality of overlapping layers.

10 Claims, 17 Drawing Sheets

(56) References Cited

U.S. PATENT DOCUMENTS

| | | | | |
|---|---|---|---|---|
| 4,627,114 | A | 12/1986 | Mitchell | |
| 5,669,079 | A | 9/1997 | Morgan | |
| 5,867,840 | A | 2/1999 | Hirosawa et al. | |
| 6,425,141 | B1 | 7/2002 | Ewing et al. | |
| 9,961,952 | B2 * | 5/2018 | Durocher | A42B 3/127 |
| 10,010,127 | B1 | 7/2018 | Shaffer et al. | |
| 2008/0066217 | A1 | 3/2008 | Depreitere et al. | |
| 2013/0276214 | A1 | 10/2013 | Wesson et al. | |
| 2014/0223644 | A1 * | 8/2014 | Bologna | A42B 3/068 2/414 |
| 2015/0157083 | A1 | 6/2015 | Lowe | |
| 2017/0265556 | A1 | 9/2017 | Yang | |
| 2018/0192728 | A1 * | 7/2018 | Cleveland | A42B 3/128 |
| 2018/0255862 | A1 * | 9/2018 | Ho | A42B 3/12 |
| 2018/0326288 | A1 * | 11/2018 | Simpson | A42B 3/128 |

* cited by examiner

PROTECTIVE HELMET WITH LINER ASSEMBLY

CROSS-REFERENCE TO RELATED APPLICATIONS

This application is a division of U.S. application Ser. No. 15/464,947, entitled "PROTECTIVE HELMET WITH LINER ASSEMBLY", filed Mar. 21, 2017, the entire contents of which are incorporated by reference herein.

TECHNICAL FIELD

The application relates generally to protective helmets, and, more particularly, to liner assemblies for such protective helmets.

BACKGROUND OF THE ART

Protective helmets used in contact sports such as hockey may include different types of internal padding to protect the head of the wearer from injury related to impacts. Various standards can be applied to certify such a helmet with respect to impact protection, each having different pass/fail criteria related to the capacity of the helmet to reduce the risk of catastrophic head injury.

As research into the effects of impacts on head injuries progresses, the test standards and related test criteria evolve to reflect such progress. Helmets which may have been certifiable under previous test standards may not qualify for certification on newer tests standards updated in light of such research.

SUMMARY

In one aspect, there is provided a protective helmet comprising: an outer shell; a liner assembly received in the outer shell and connected to the outer shell, the liner assembly defining a front portion configured to overlay a front of a head of a wearer, a rear portion configured to overlay a rear of the head of the wearer, a top portion configured to overlay a top of the head of the wearer, and two opposed side portions each configured to overlay a respective side of the head of the wearer; wherein each of the front, rear, side and top portions includes at least one zone where the liner assembly includes a plurality of overlapping layers, each of the layers being made from one of first, second, third and fourth materials, where the first material has a greater density than that of the second, third and fourth materials, the second material has a greater density than that of the third and fourth materials, and the third material has a greater density than that of the fourth material, and: the at least one zone of the front portion includes at least one of the zones F1, F2 and F3 where the layers are made of the material and have a respective thickness of at least the thickness set forth in Table 4; the at least one zone of the rear portion includes at least one of the zones R1 and R2 where the layers are made of the material and have a respective thickness of at least the thickness set forth in Table 4; the at least one zone of the side portions include at least one of the zones S1 and S2 where the layers are made of the material and have a respective thickness of at least the thickness set forth in Table 4; and the at least one zone of the top portion includes at least one of the zones T1 and T2 where the layers are made of the material and have a respective thickness of at least the thickness set forth in Table 4.

In another aspect, there is provided a protective helmet comprising: an outer shell; a liner assembly received in the outer shell and connected to the outer shell, the liner assembly having at least one zone where the liner assembly includes a plurality of overlapping layers, each of the layers being made from one of first, second, third and fourth materials, where the first material has a greater density than that of the second, third and fourth materials, the second material has a greater density than that of the third and fourth materials, and the third material has a greater density than that of the fourth material, and wherein the at least one zone includes at least one of the zones F1, F2, F3, R1, R2, S1, S2, T1 and T2 where the layers are made of the material and have a respective thickness of at least the thickness set forth in Table 4.

In a further aspect, there is provided a protective helmet comprising: an outer shell; a liner assembly received in the outer shell and connected to the outer shell, the liner assembly defining a front portion configured to overlay a front of a head of a wearer, a rear portion configured to overlay a rear of the head of the wearer, a top portion configured to overlay a top of the head of the wearer, and two opposed side portions each configured to overlay a respective side of the head of the wearer; wherein each of the front, rear, side and top portions includes at least one zone where the liner assembly includes a plurality of overlapping layers, each of the layers being made from one of first, second, third and fourth materials, where the first material has a greater hardness than that of the second, third and fourth materials, the second material has a greater hardness than that of the third and fourth materials, and the third material has a greater hardness than that of the fourth material, and: the at least one zone of the front portion includes at least one of the zones F1, F2 and F3 where the layers are made of the material and have a respective thickness of at least the thickness set forth in Table 4; the at least one zone of the rear portion includes at least one of the zones R1 and R2 where the layers are made of the material and have a respective thickness of at least the thickness set forth in Table 4; the at least one zone of the side portions include at least one of the zones S1 and S2 where the layers are made of the material and have a respective thickness of at least the thickness set forth in Table 4; and the at least one zone of the top portion includes at least one of the zones T1 and T2 where the layers are made of the material and have a respective thickness of at least the thickness set forth in Table 4.

In another aspect, there is provided a protective helmet comprising: an outer shell; and a liner assembly received in the outer shell and connected to the outer shell, the liner assembly defining a front portion configured to overlay a front of a head of a wearer, a rear portion configured to overlay a rear of the head of the wearer, a top portion disposed above and out of contact with a top of the head of the wearer when the helmet is worn, and two opposed side portions each configured to overlay a respective side of the head of the wearer; and wherein each of the front, rear, side and top portions includes at least one zone where the liner assembly includes a plurality of overlapping layers.

In another aspect, there is provided a protective helmet comprising: an outer shell; and a liner assembly received in the outer shell and connected to the outer shell, the liner assembly defining a front portion configured to overlay a front of a head of a wearer, a rear portion configured to overlay a rear of the head of the wearer, a top portion above the head of the wearer when the helmet is worn, and two opposed side portions each configured to overlay a respective side of the head of the wearer; and wherein the front portion consists two layers of energy absorption foam, and the rear portion includes at least three layers of energy absorption foam.

DESCRIPTION OF THE DRAWINGS

Reference is now made to the accompanying figures in which.

DETAILED DESCRIPTION

The present disclosure provides for a liner assembly for a helmet which in a particular embodiment is particularly suitable to attenuate the impact severity experienced during testing in accordance with Virginia Tech's Hockey STAR testing methodology and rating, considering front, rear, side and top impact locations. The Hockey STAR testing methodology may be for example as set forth in "*Hockey STAR: A Methodology for Assessing the Biomechanical*" from Rowson et al. (Annals of Biomedical Engineering, Vol. 43, No. 10, October 2015, pp. 2429-2443), which is incorporated by reference herein.

Referring to FIGS. 1*a*, 1*b*, 1*c* and 1*d*, a protective helmet 10 is generally shown. In a particular embodiment, the helmet 10 is a hockey helmet, configured for example to be used in ice hockey; other configurations and uses are also possible. The helmet 10 includes an outer shell 12 which can be made of any type of adequate material, including but not limited to, fiber reinforced materials, thermoplastics, and a combination thereof. In a particular embodiment, the outer shell is made of high density polyethylene (HDPE).

In the embodiment shown, the outer shell 12 includes a front shell portion 12*f* and a rear shell portion 12*r* which are interconnected so as to be selectively movable with respect to each other through a relative sliding motion, in order to adjust a dimension of the helmet; releasable locking members 14 (FIGS. 1*b*, 1*d*), for example provided along the sides of the helmet 10, allow to selectively lock and unlock the relative position of the front and rear shell portions 12*f*, 12*r*, so as to selectively prevent and allow the relative sliding motion between the front and rear shell portions 12*f*, 12*r*. Alternately, the outer shell 12 may be made of a single piece, of more than two relatively movable pieces, or of two pieces relatively movable in a manner different from that shown in the Figures.

Figure 1B:
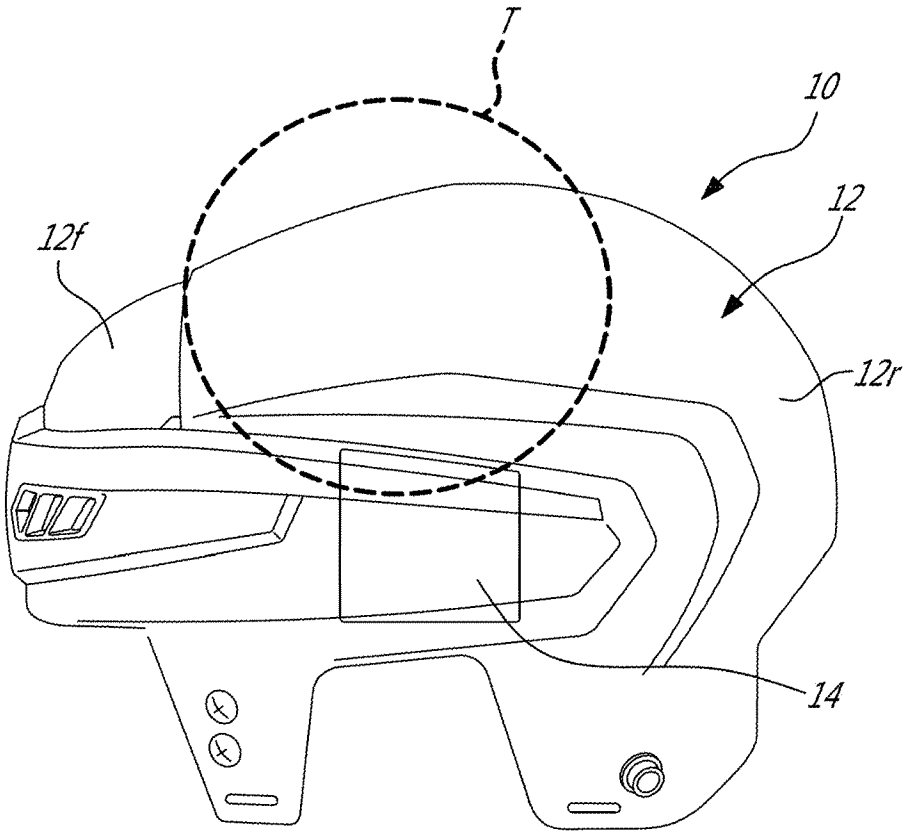
FIG. 1*b* is a schematic side view of the helmet of FIG. 1*a*, showing an example of top impact location.
Figure 1A:
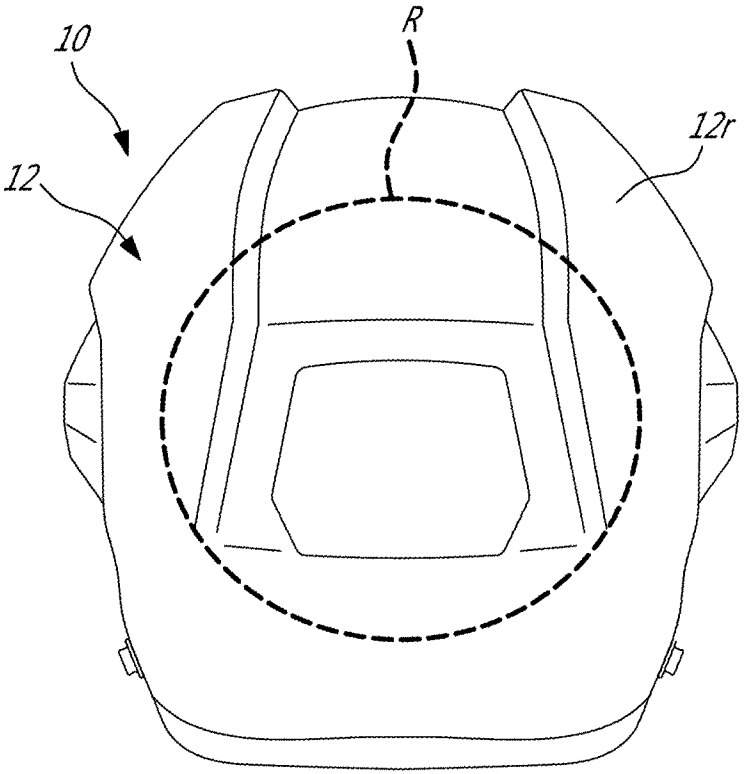
FIG. 1*a* is a schematic rear view of a helmet in accordance with a particular embodiment, showing an example of rear impact location.
Figure 1D:
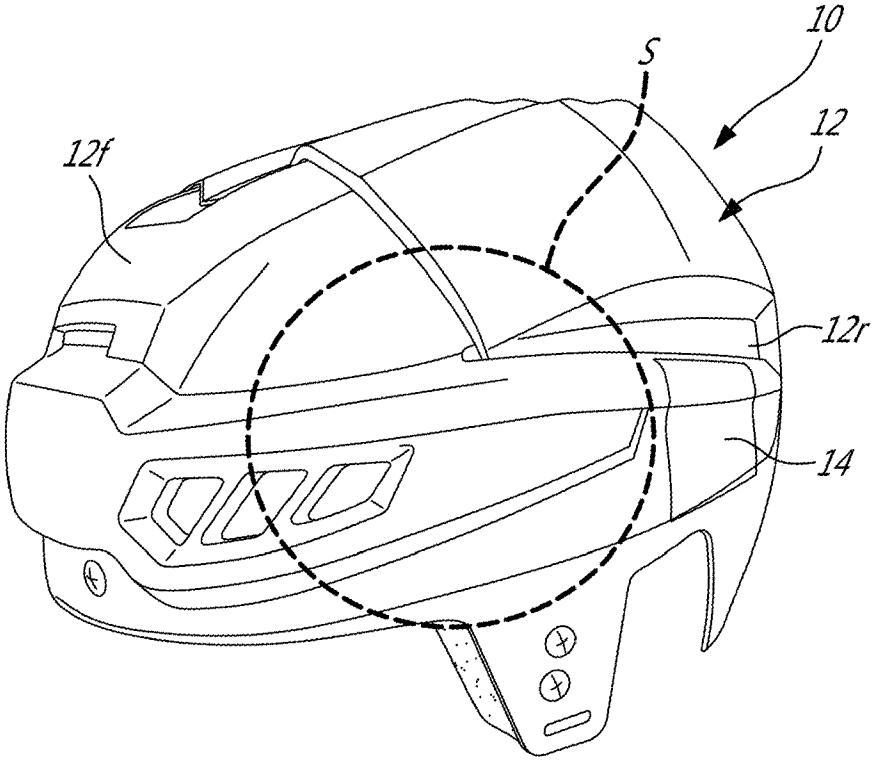
FIG. 1*d* is a schematic tridimensional view of the helmet of FIG. 1*a*, showing an example of side impact location.
Figure 1C:
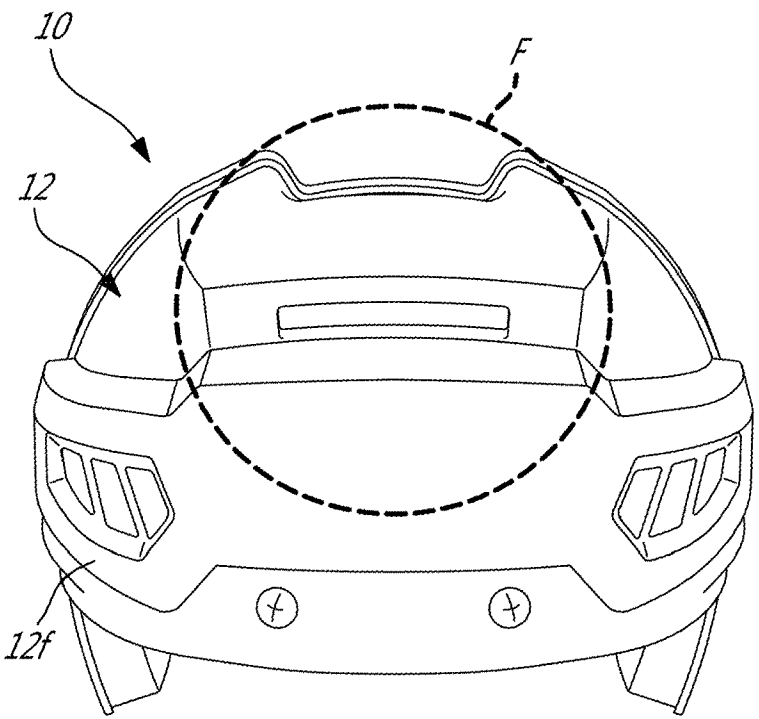
FIG. 1*c* is a schematic front view of the helmet of FIG. 1*a*, showing an example of front impact location.

During a game, the helmet 10 is susceptible to receive impacts, such as for example impacts from a puck or a hockey stick, and impacts resulting from a fall of the wearer or a collision with a structure or another player. In a particular embodiment, the capacity of the helmet 10 to absorb impacts is tested with respect to four types of impacts: a rear impact in a rear location R (FIG. 1*a*), a top impact in a top location T (FIG. 1*b*), a front impact in a front location F (FIG. 1*c*) and a side impact in a side location S (FIG. 1*d*). The impact locations may be non-centric, i.e. with a direction of the impact force not in alignment with a center of gravity of the head (for example, for the side and top impact locations S, T), or centric, i.e. with a direction of the impact force aligned with the center of gravity of the head (for example, for the front and rear impact locations F, R). In a particular embodiment, the helmet 10 is tested following test parameters set forth by the Hockey STAR methodology as set forth above; other methodologies may alternately be used, including, but not limited to, other versions of the Hockey STAR methodology differing from that set forth in the Rowson et al. reference discussed above.

Figure 2:
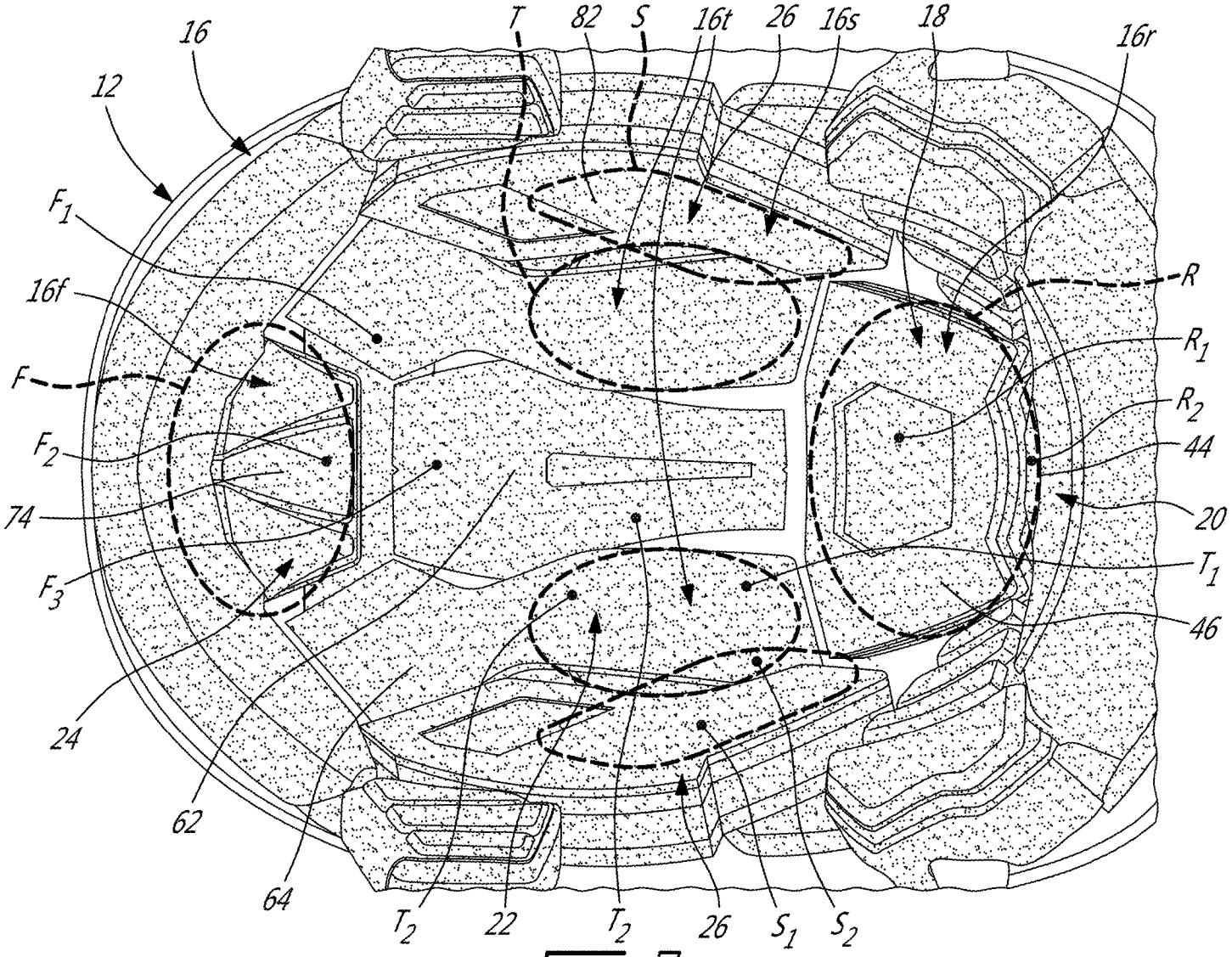
FIG. 2 is a schematic bottom view of the helmet of FIG. 1*a*, showing a liner assembly of the helmet in accordance with a particular embodiment.

Referring to FIG. 2, the helmet 10 includes a liner assembly 16 received in the outer shell 12 and connected to the outer shell 12. The liner assembly 16 generally includes a front portion 16*f* configured to overlay a front of a head of a wearer and to absorb front impact forces (e.g. impacts on the front location F), a rear portion 16*r* configured to overlay a rear of the head of the wearer and to absorb rear impact forces (e.g. impacts on the rear location R), a top portion 16*t* configured to overlay a top of the head of the wearer and to absorb top impact forces (e.g. impacts on the top locations T), and two opposed side portions 16*s* each configured to overlay a respective side of the head of the wearer and to absorb side impact forces (e.g. impact on the side locations S). Although in a particular embodiment, each of the front portion 16*f*, rear portion 16*r*, top portion 16*t* and side portions 16*s* covers at least the corresponding impact location F, R, T, S, it is understood that each of the front portion 16*f*, rear portion 16*r*, top portion 16*t* and side portions 16*s* may be larger than the corresponding impact location F, R, T, S. For example, in the embodiment shown, the top portion 16*t* is configured to overlay the top of the head of the wearer, in alignment and between the two top impact locations T. Other configurations are of course possible.

In the embodiment shown, the liner assembly 16 generally includes an upper rear assembly 18 and an occipital assembly 20 which are interconnected, and an upper front assembly 22, lower front assembly 24, and side assemblies 26 which are interconnected. The front portion 16*f* of the liner assembly 16 is defined at least in part by the upper and lower front assemblies 22, 24. The rear portion 16*r* of the liner assembly 16 is defined at least in part by the upper rear and occipital assemblies 18, 20. The top portion 16*t* of the liner assembly 16 is defined at least in part by the upper front assembly 22. The side portions of the liner assembly are defined at least in part by the side and upper front assemblies 26, 22.

In the present disclosure, including claims, it is understood that the expressions "outward of", "outwardly of" and related terms indicate that an element is located further from the head of the wearer than another when the helmet is properly worn, and that the expressions "inward of", "inwardly of" and related terms indicate that an element is located closer to the head of the wearer than another when the helmet is properly worn. For example, the outer shell 12 is located outwardly of the liner assembly 16. The terms "front", "frontwardly", "rear", "rearwardly", "top", "bottom" and other spatial terms refer to the position of the associated element when the pads are assembled in the helmet and when the helmet is properly worn by a standing wearer.

In a particular embodiment, the liner assembly 16 further includes a band of pads disposed in a headband configuration against the bottom of the inner surface of the outer shell 12 around the head of the wearer, and located outwardly of the various pad assemblies; the band may also define part of the front, rear and side portions of the liner assembly 16. The band 28, a particular embodiment of which is shown in FIGS. 3*a* to 7*b*, generally includes a front pad 30, two first side pads 32, two second side pads 34, and outer and inner rear pads 36, 38. It is understood that the particular configuration of band 28 shown and described herein is exemplary only, that any other suitable configuration and number of pads may alternately be used, and that the pads may have any other suitable shape. Moreover, the band 28 may be omitted if the other elements of the liner assembly 16 provide adequate protection.

Figure 3A:
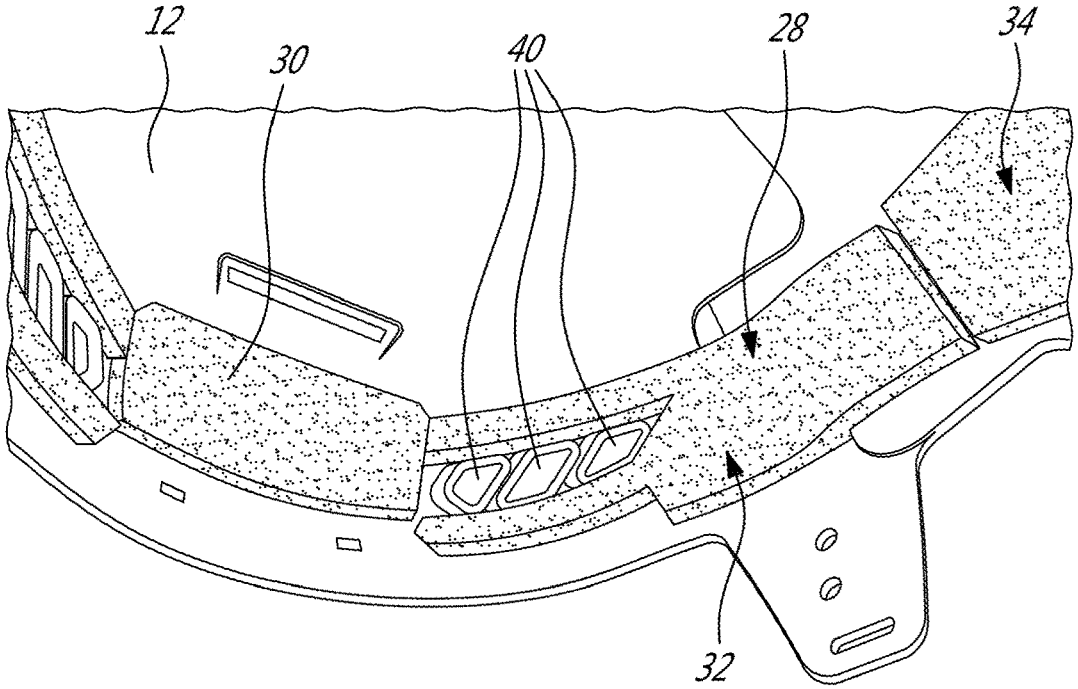
FIG. 3*a* is a schematic tridimensional bottom view of part of an outer shell of the helmet of FIG. 1*a*, showing part of a band of the liner assembly of FIG. 2 in accordance with a particular embodiment.
Figure 4:
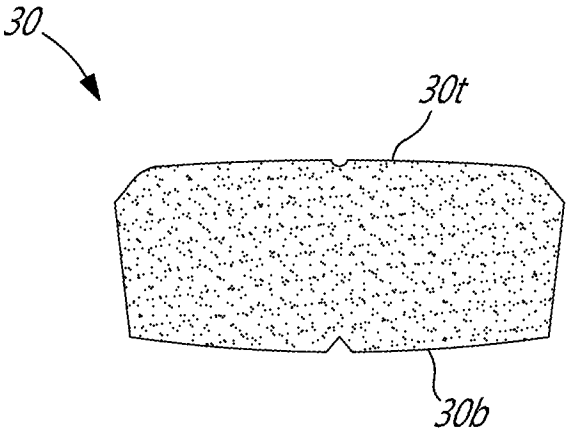
FIG. 4 is a schematic inner view of a front pad of the band of the liner assembly of FIG. 2 in accordance with a particular embodiment.

Referring to FIG. 4, the front pad 30 has a shape which is substantially rectangular, with small indents formed at the center of its top and bottom edges 30*t*, 30*b*. The bottom edge 30*b* is slightly smaller than the top edge 30*t*, so that the front pad has a slightly bevelled shape. Referring to FIG. 3*a*, the front pad 30 is connected to the inner surface of the outer shell 12, for example by a suitable adhesive, in proximity of the bottom edge of the outer shell 12 but upwardly spaced therefrom. In use, the center of the front pad 30 is aligned with a central axis of the helmet 12, and the front pad 30 is aligned with the forehead of the wearer.

Figure 5:
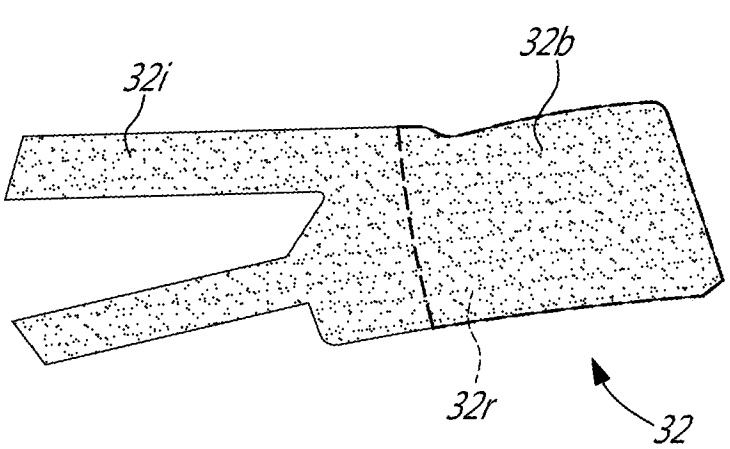
FIG. 5 is a schematic inner view of a first side pad of the band of the liner assembly of FIG. 2 in accordance with a particular embodiment.

Referring to FIG. 5, the first side pads 32 each include a body 32*b* having a substantially rectangular shape, and two spaced apart elongated legs 32*l* extending frontwardly from a front edge of the pad 32. Referring to FIG. 3*a*, the legs 32*l* are configured so as to receive openings 40 (e.g. vents) of the outer shell 12 therebetween. The first side pads 32 are disposed on a respective side of the front pad 30, with the legs 32*l* abutting or in close proximity to the respective side edge of the front pad 30. The first side pads 32 are connected to the inner surface of the outer shell 12 in proximity of its bottom edge by upwardly spaced therefrom, for example by having the legs 32*l* connected to the inner surface of the outer shell by a suitable adhesive. A rear portion 32*r* of the body 32, shown in FIG. 5 by dotted lines, and which in use overlaps a protuberance of the outer shell 12, remains free of adhesive and accordingly is not directly connected to the outer shell 12.

Figure 3B:
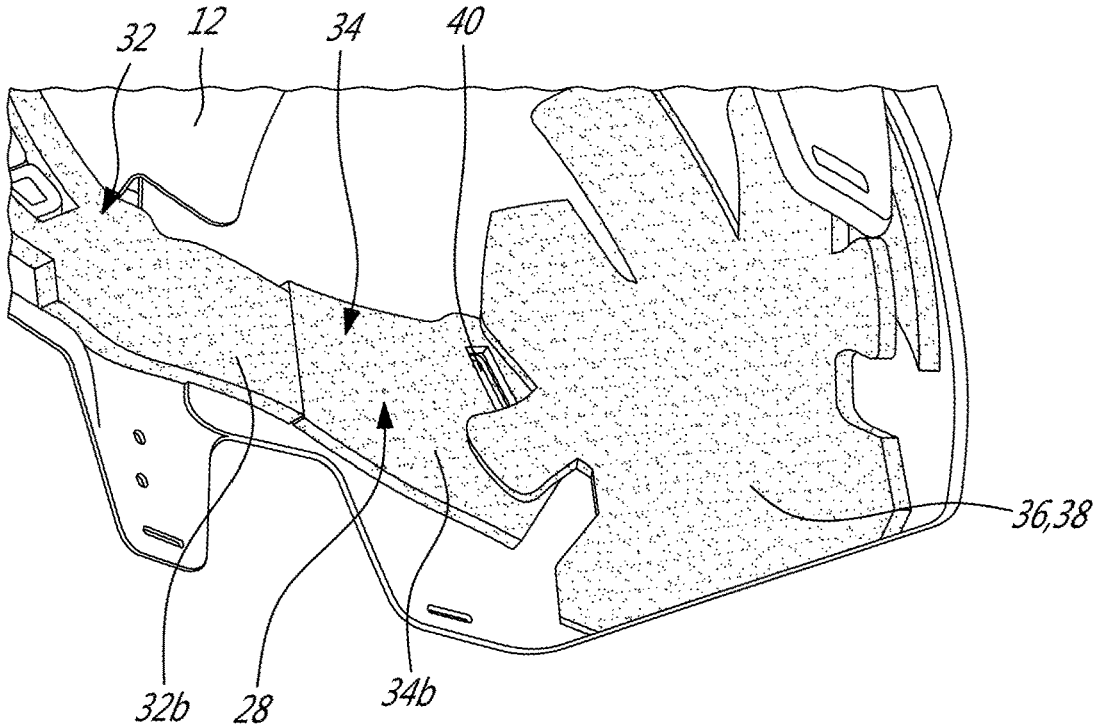
FIG. 3*b* is a schematic tridimensional bottom view of another part of the outer shell of FIG. 3*a*, showing another part of the band of the liner assembly of FIG. 2 in accordance with a particular embodiment.
Figure 6:
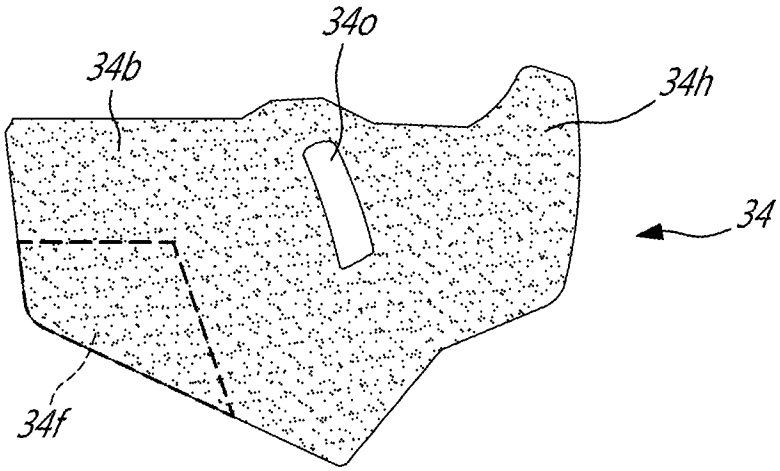
FIG. 6 is a schematic inner view of a second side pad of the band of the liner assembly of FIG. 2 in accordance with a particular embodiment.

Referring to FIG. 6, the second side pads 34 each include a body 34*b* having a trapezoidal shape, and a hook 34*h* extending rearwardly from the body 34*b*. An opening 34*o* is defined through the pad 34 at the junction between the body 34*b* and the hook 34*h*. Referring to FIG. 3*b*, the pad opening 34*o* is configured so as be aligned with an opening 40 (e.g. vent) of the outer shell 12. The second side pads 34 are each disposed rearwardly of a respective first side pad 32, with the front edge of the body 34*b* of the second side pad abutting or in close proximity to the rear edge of the body 32*b* of the respective first side pad 32. The second side pads 34 are connected to the inner surface of the outer shell 12, for example by a suitable adhesive, in proximity of the bottom edge of the outer shell 12 but upwardly spaced therefrom. A front portion 34*f* of the body 34, shown in FIG. 6 by dotted lines, and which In use overlaps the protuberance of the outer shell 12, remains free of adhesive and accordingly is not directly connected to the outer shell 12.

Figure 7B:
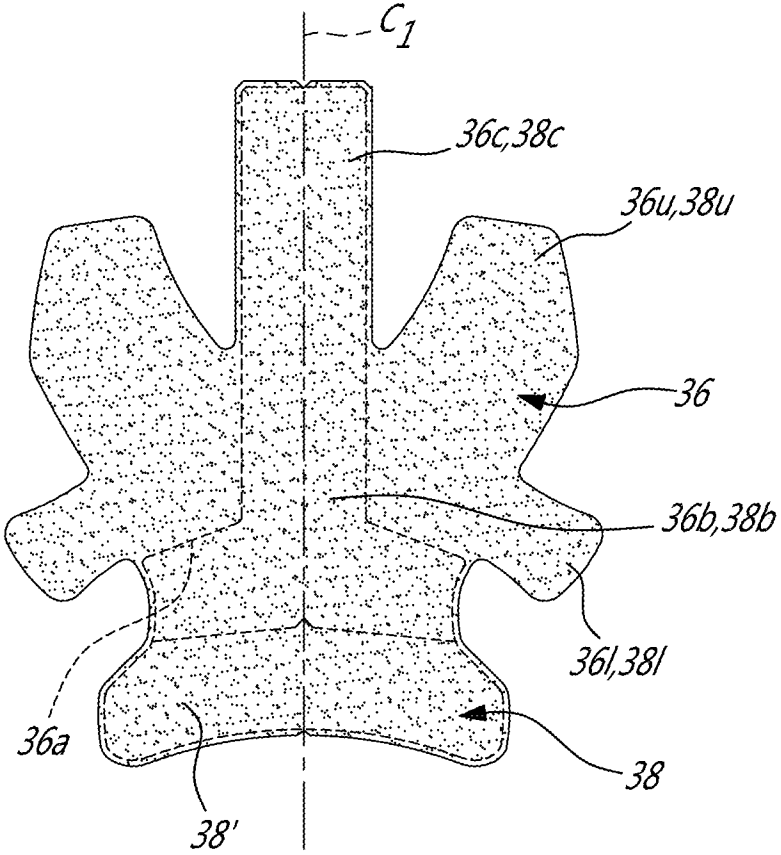
FIGS. 7*a*-7*b* are schematic inner and outer views, respectively, of rear pads of the band of the liner assembly of FIG. 2 in accordance with a particular embodiment.
Figure 7A:
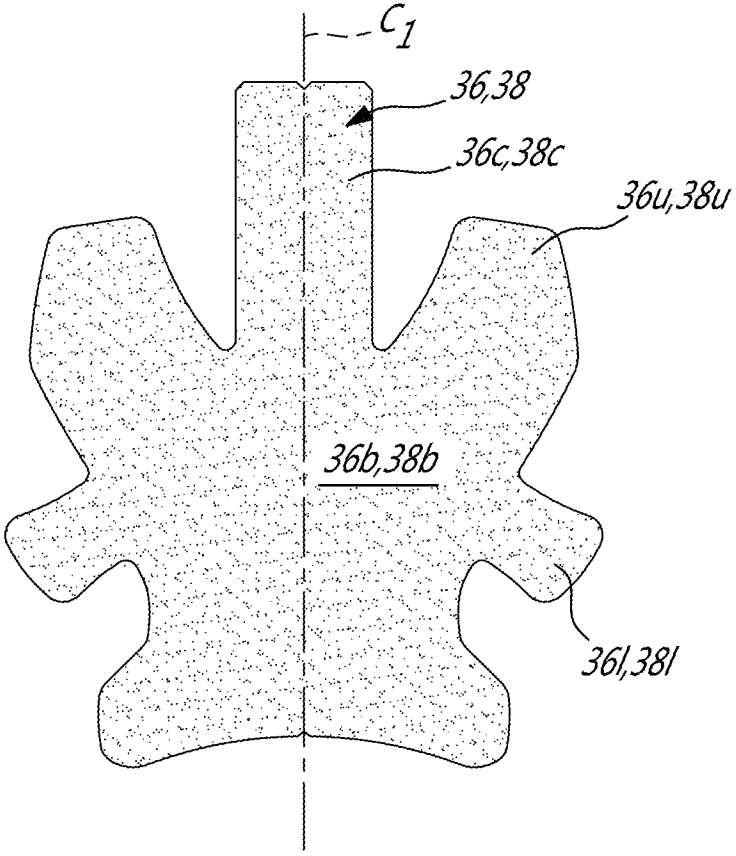

Referring to FIGS. 7*a*-7*b*, the outer and inner rear pads 36, 38 of the band 28 are similarly shaped, except along the bottom where the inner rear pad 38 extends beyond the outer rear pad 36. Each of the rear pads 36, 38 includes a body 36*b*, 38*b* from which extends a central portion 36*c*, 38*c*, two upper legs 36*u*, 38*u*, and two lower legs 36*l*, 38*l*. The central portion 36*c*, 38*c* extends upwardly along a central axis $C_1$ of the rear pad 36, 38. The upper legs 36*u*, 38*u* extend laterally and upwardly from a respective side of the body 36*b*, 38*b*, and the lower legs 36*l*, 38*l* extend laterally and downwardly from a respective side of the body 36*b*, 38*b*, defining a star-like shape symmetrical about the central axis $C_1$. The inner rear pad 38 has an enlarged bottom portion 38' extending downwardly and laterally from the outer rear pad 36. The inner and outer rear pads 36, 38 are connected to each other, for example by a suitable adhesive or lamination process, and the outer rear pad 36 is connected to the inner surface of the outer shell 12, for example by a suitable adhesive. The adhesive connecting the outer rear pad 36 to the outer shell 12 is provided in a central region 36*a* of the outer surface of the outer rear pad 36, so that the legs 36*u*, 36*l* remain free of adhesive and accordingly are not directly connected to the outer shell 12. As can be seen in FIG. 3*b*, the legs 36*u*, 36*l* overlap the adjacent second side pad 34 without being connected thereto. In use, the rear pads 36, 38 are aligned with an occipital region of the wearer's head.

A particular embodiment of the interconnected upper rear and occipital assemblies 18, 20 is shown in FIGS. 8 to 11*a*. It is however understood that the configuration shown and described herein is exemplary only, that any other suitable configuration and number of pads may alternately be used, and that the pads may have any other suitable shape.

Figure 8:
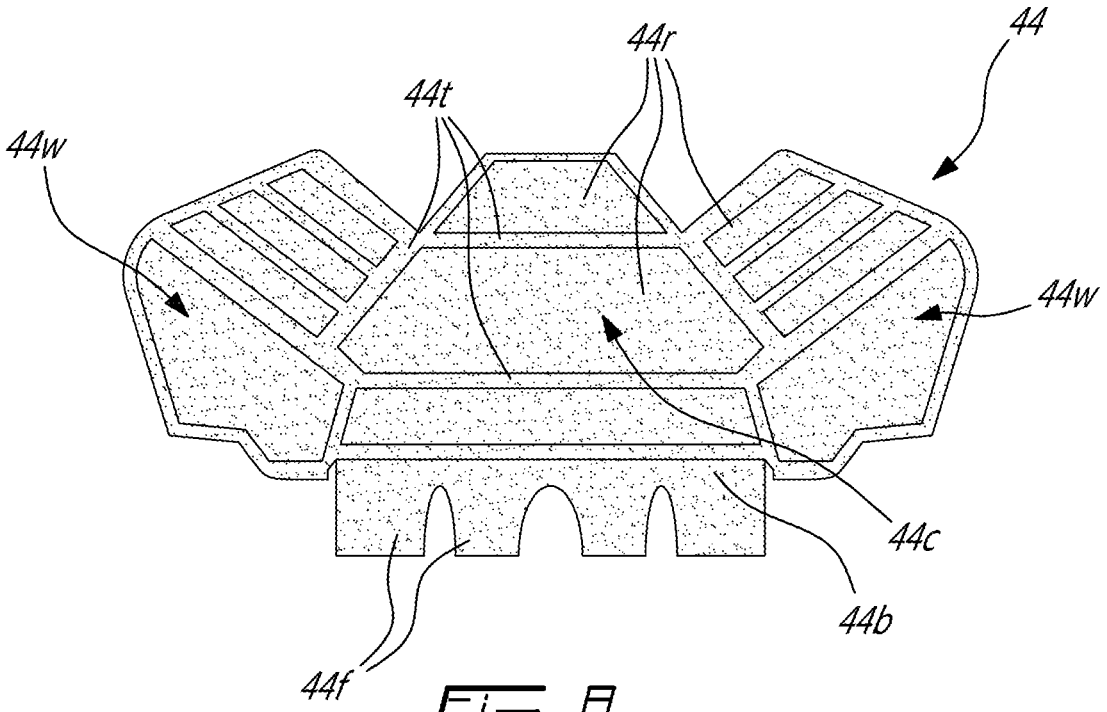
FIG. 8 is a schematic inner view of an inner occipital pad of the liner assembly of FIG. 2 in accordance with a particular embodiment.

Referring to FIGS. 8 to 10*b*, the occipital assembly 20 includes an outer occipital pad 42 and an inner occipital pad 44. Referring to FIG. 8, the inner occipital pad 44 is molded such that its inner surface includes a plurality of thicker raised sections 44*r* which are spaced apart by thinner linear recessed sections 44*t*. In the embodiment shown, the inner occipital pad 44 includes a central portion 44*c* having a truncated triangular shape, and two wings 44*w* each extending from a respective side of the central portion 44*c*. Raised sections 44*r* are defined in the central portion 44*c*, spaced apart by horizontal recessed sections 44*t*. The side edges of the central portion 44*c* are also defined by recessed sections 44*t*, which separate the central portion 44*c* from the wings 44*w*. Each wing 44*w* also includes raised sections 44*r* separated by linear recessed sections 44*t*. A bottom portion 44*b* extends from a bottom edge of the central portion 44*c*. The bottom portion has a thickness similar to that of the recessed sections 44*t*, and defines a plurality of spaced apart fingers 44*f*.

Figure 9:
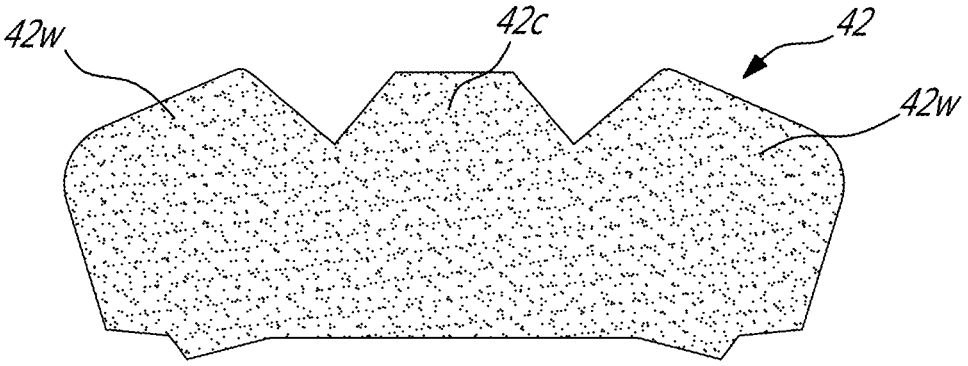
FIG. 9 is a schematic inner view of an outer occipital pad of the liner assembly of FIG. 2 in accordance with a particular embodiment.
Figure 10A:
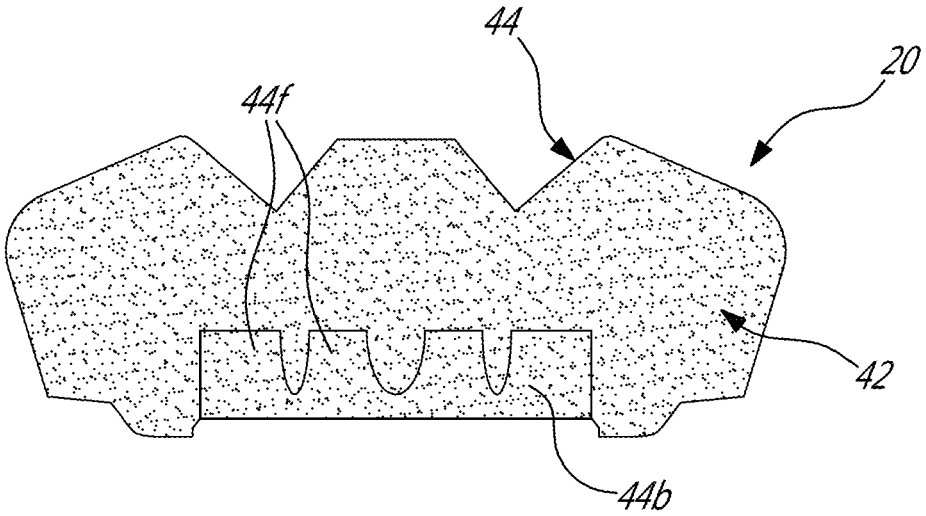
FIGS. 10*a*-10*b* are schematic outer and inner views, respectively, of an occipital assembly including the occipital pads of FIGS. 8-9.
Figure 10B:
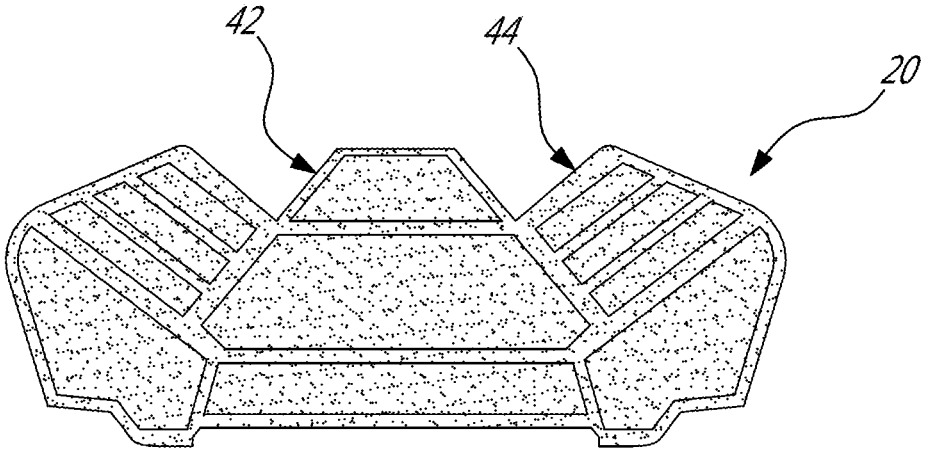

Referring to FIG. 9, the outer occipital pad 42 includes a central portion 42*c* and wings 42*w* shape substantially similarly to that of the inner occipital pad 44. The outer occipital pad 42 however has a constant thickness and does not include a bottom portion similar to that of the inner occipital pad 44. As can be best seen in FIG. 10*a*, the inner surface of the outer occipital pad 42 is connected to the outer surface of the inner occipital pad 44, for example by a suitable adhesive or a lamination process, and the bottom portion 44*b* of the inner occipital pad 44 is folded and "wrapped" around the bottom edge of the outer occipital pad 42, so that the fingers 44*f* are connected to the outer surface of the outer occipital pad 42.

Figure 11A:
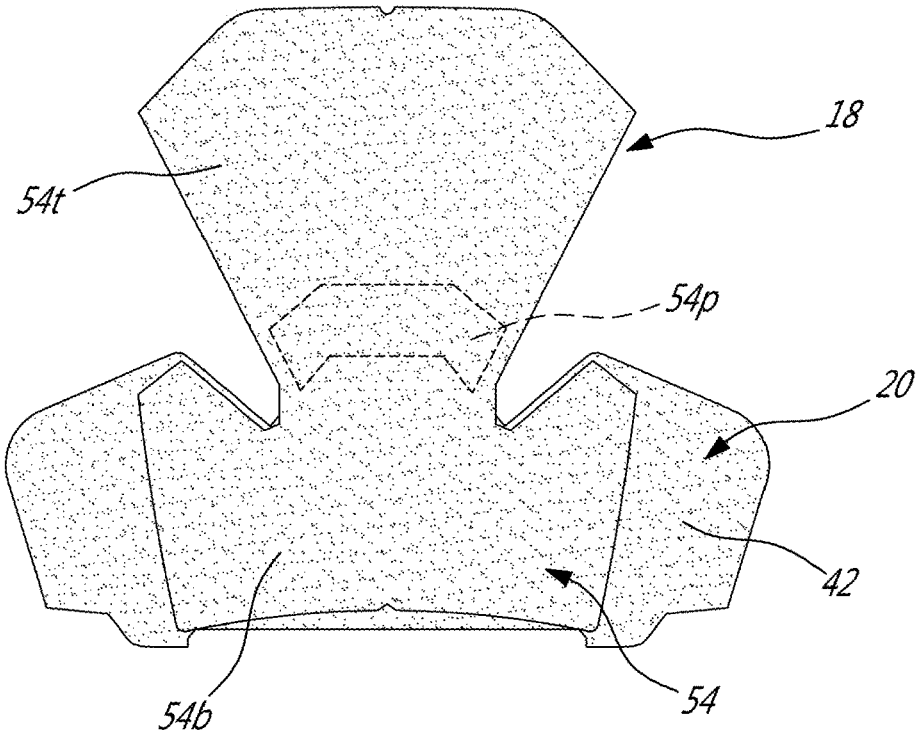
FIG. 11*a* is a schematic outer view of the occipital assembly of FIGS. 10*a*-10*b* connected to a rear connecting pad, in accordance with a particular embodiment.
Figure 11B:
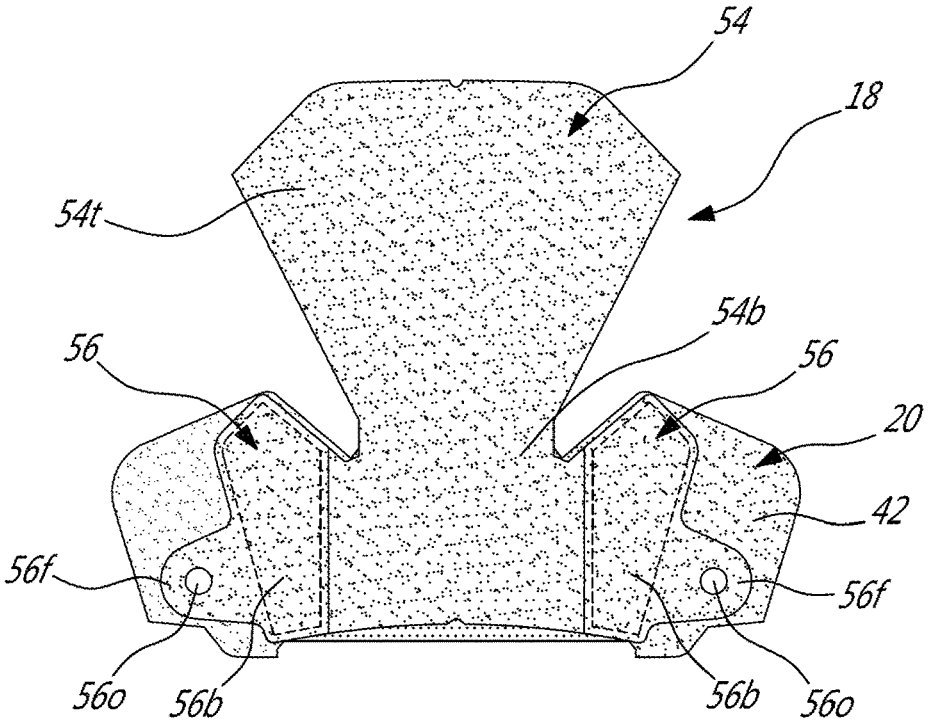
FIG. 11*b* is a schematic outer view of the assembly of FIG. 11*a* to which connecting pieces have been added, in accordance with a particular embodiment.
Figure 11C:
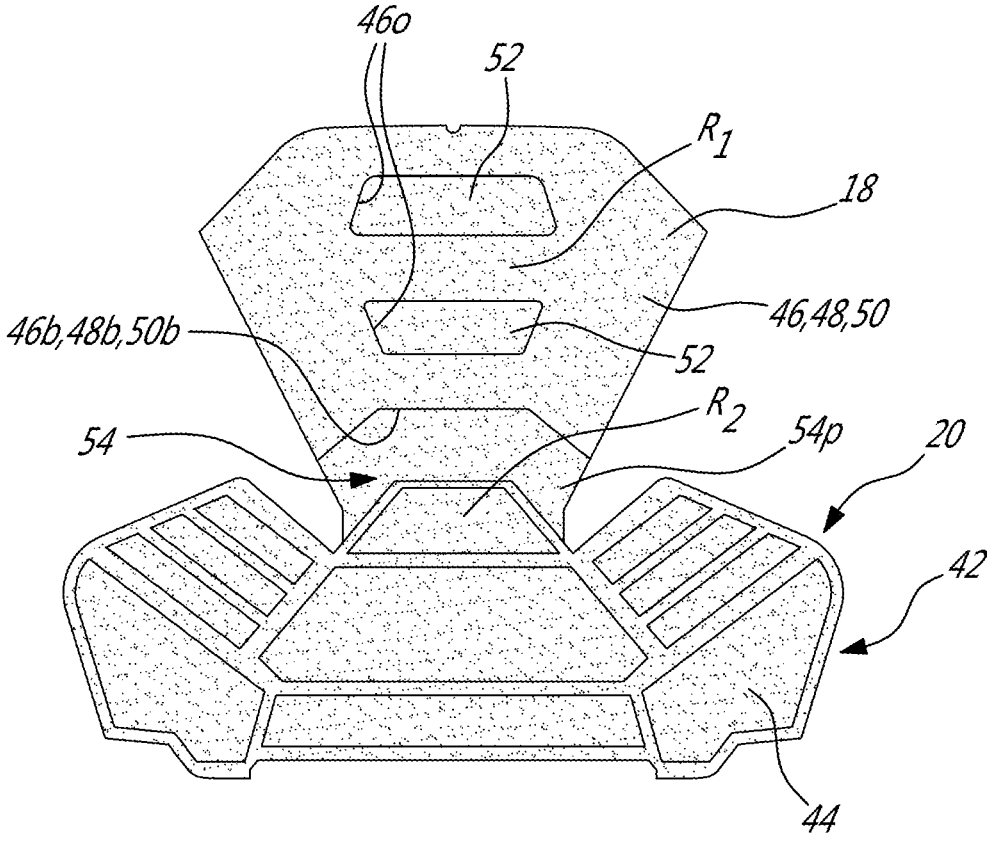
FIG. 11*c* is a schematic inner view of the assembly of FIG. 11*b*, showing an upper rear assembly of the liner assembly of FIG. 2 in accordance with a particular embodiment.

Referring to FIG. 11*c*, the upper rear assembly 18 includes inner, intermediate and outer rear pads 46, 48, 50 which have the same shape and are connected to each other, for example by a suitable adhesive or by lamination. Each rear pad 46, 48, 50 has a shape corresponding to two trapezoids connected by their larger base, with the bottom trapezoid having a greater height than the top trapezoid. The bottom edges 46*b*, 48*b*, 50*b* of the pads have a trapezoid shaped notch defined therein, having a shape complementary to that of the central portions of the pads of the occipital assembly 20. The inner read pad 46 includes two elongated openings 46*o* defined therethrough. A complementary shaped insert pad 52 is received in each of the openings, which in a particular embodiment is made of rate sensitive material, i.e. material that displays different properties when exposed to different rates of strain. For example, compression rate sensitive materials may elastically compress or deform when exposed to lighter impacts, while stiffening up when exposed to harder impacts. The rate sensitive material can be any suitable polymeric cellular material, such as polyurethane foams or elastomers manufactured by D30®, or any other foam or elastomer material having similar properties. Other types of materials (e.g. foam) may alternately be used. In another particular embodiment, the openings 46*o* in the inner rear pad 46 and the complementary shaped insert pads 52 are omitted.

Referring to FIGS. 11*a* and 11*c*, the upper rear assembly 18 and the occipital assembly 20 are both connected to a rear connecting pad 54, with a middle portion 54*p* of the rear connecting pad 54 remaining free therebetween. The rear connecting pad 54 has a top portion 54*t* shaped complementary to the upper rear assembly 18 and connected to the outer surface of the outer rear pad 50, and a bottom portion 54*b* shaped complementary to a central section of the occipital assembly 20 and connected to the outer surface of the outer occipital pad 42, so that the occipital assembly 20 extends laterally from the rear connecting pad 54.

Referring to FIG. 11*b*, two connecting pieces 56, made for example of fabric (e.g. a suitable grade of polyester), each include a body 56*b* connected to the outer surface of the bottom portion 54*b* of the rear connecting pad 54 by suitable adhesive, and a finger 56*f* extending laterally from the body 56*b* without being directly connected to the pads. Each finger 56*f* has an opening 56*o* defined therethrough. The interconnected upper rear assembly 18 and occipital assembly 20 are connected to the outer shell 12 by fasteners (not shown) inserted through the openings 56*o*, for example a respective screw extending through each opening 56*o* and connected to the outer shell 12, and retained to the connecting piece 56 by a respective nut (not shown). Referring back to FIG. 2, the inner surfaces of the inner rear pad 46 and of the inner occipital pad 44 are visible in the interior of the helmet 10 when the liner assembly 16 and outer shell 12 are interconnected. The rear connecting pad 54 (not visible in FIG. 2) is sufficiently flexible to conform to the rounded shape of the inner surface of the outer shell 12, and once installed in the outer shell 12 the upper rear assembly 18 and the occipital assembly 20 are adjacent one another due to the deformation of the rear connecting pad 54.

A particular embodiment of the upper front assembly 22 is shown in FIGS. 12*a* to 14*b*. It is however understood that the configuration shown and described herein is exemplary only, that any other suitable configuration and number of pads may alternately be used, and that the pads may have any other suitable shape.

Figure 12A:
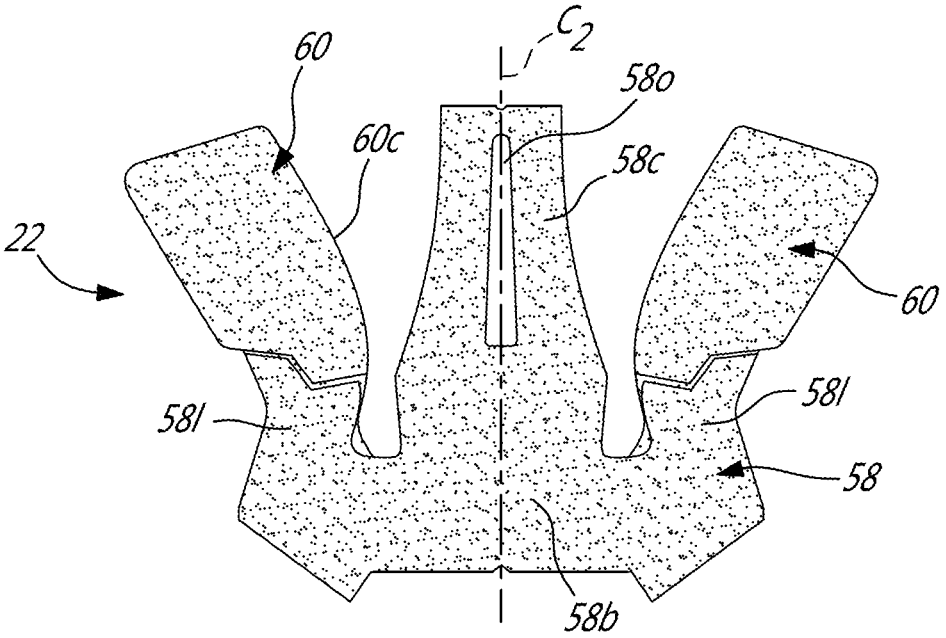
FIGS. 12*a*-12*b* are schematic outer and inner views, respectively, of part of an upper front assembly of the liner assembly of FIG. 2 in accordance with a particular embodiment, including intermediate central and lateral pads, and inner central and lateral pads.

Referring to FIG. 12*a*, the upper front assembly 22 includes an intermediate central pad 58 and two intermediate lateral pads 60. The intermediate central pad 58 includes a base 58*b*, an elongated central portion 58*c* extending upwardly from the base 58*b* along its central axis $C_2$, and two legs 58*l* extending upwardly from the base 58*b* on a respective side of the central portion 58*c*, substantially shorter than the central portion 58*c*. The central portion 58*c* has a tapering trapezoidal shape, and has an elongated opening 58*o* defined therethrough along the central axis $C_2$. The intermediate lateral pads 60 are each provided adjacent a respective one of the legs 58*l* of the intermediate central pad 58, and extend upwardly therefrom as a prolongation of the legs 58*l*. The intermediate lateral pads 60 have a curved shape with the convex edge 60*c* facing the central portion 58*c* of the intermediate central pad 58.

Figure 12B:
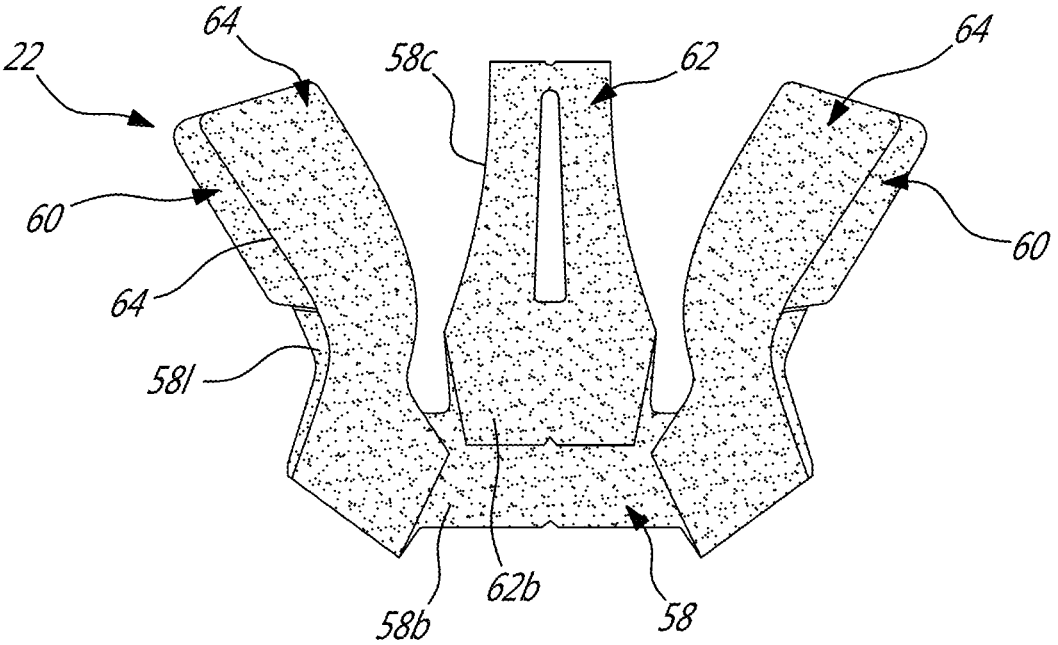

Referring to FIG. 12*b*, the upper front assembly 22 further includes an inner central pad 62 and two inner lateral pads 64. The inner central pad 62 is connected to the inner surface of the central portion 58*c* of the intermediate central pad 58, and has a shape complementary thereto, with a bottom portion 62*b* extending to slightly overlap the base 58*b* of the intermediate central pad 58. Each inner lateral pad 64 is connected to the inner surface of a respective leg 58*l* and side portion of the base 58*b* of the intermediate central pad 58 and to the inner surface of a respective intermediate lateral pad 60. Each inner lateral pad 64 has a shape similar to the intermediate central pad leg 58*l* and to the intermediate lateral pad 60 it overlaps, but has a slightly smaller width so that intermediate central pad leg 58*l* and intermediate lateral pad 60 extend laterally from the concave edge 64*c* of the inner lateral pad 64. The break between the intermediate central pad leg 58*l* and the intermediate lateral pad 60 allow the intermediate lateral pad 60 to more easily conform to the curved shape of the outer shell 12 when the upper front assembly 22 is installed.

Figure 13A:
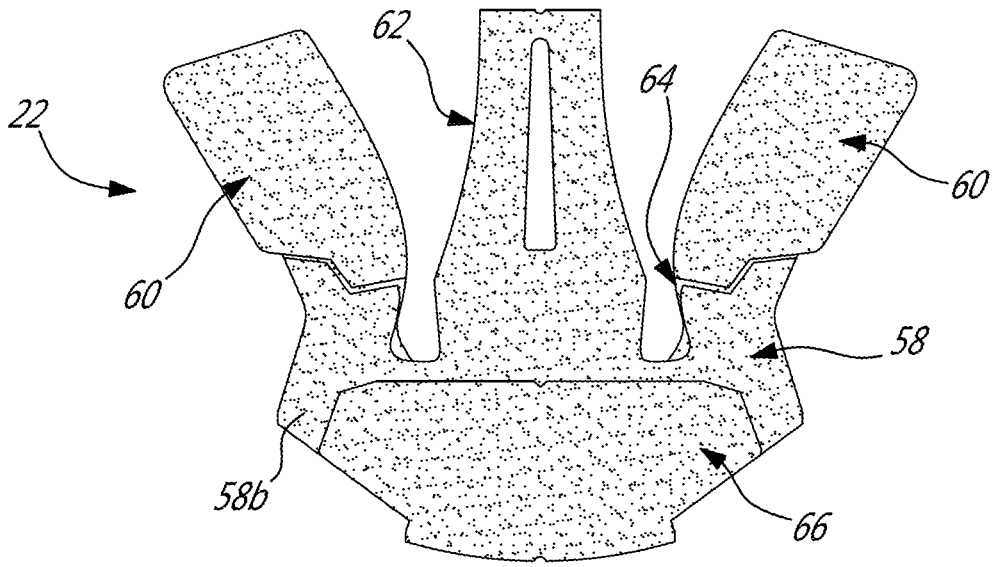
FIGS. 13*a*-13*b* are schematic outer and inner views, respectively, of the assembly of FIGS. 12*a*-12*b* to which an outer central pad has been added, in accordance with a particular embodiment.
Figure 13B:
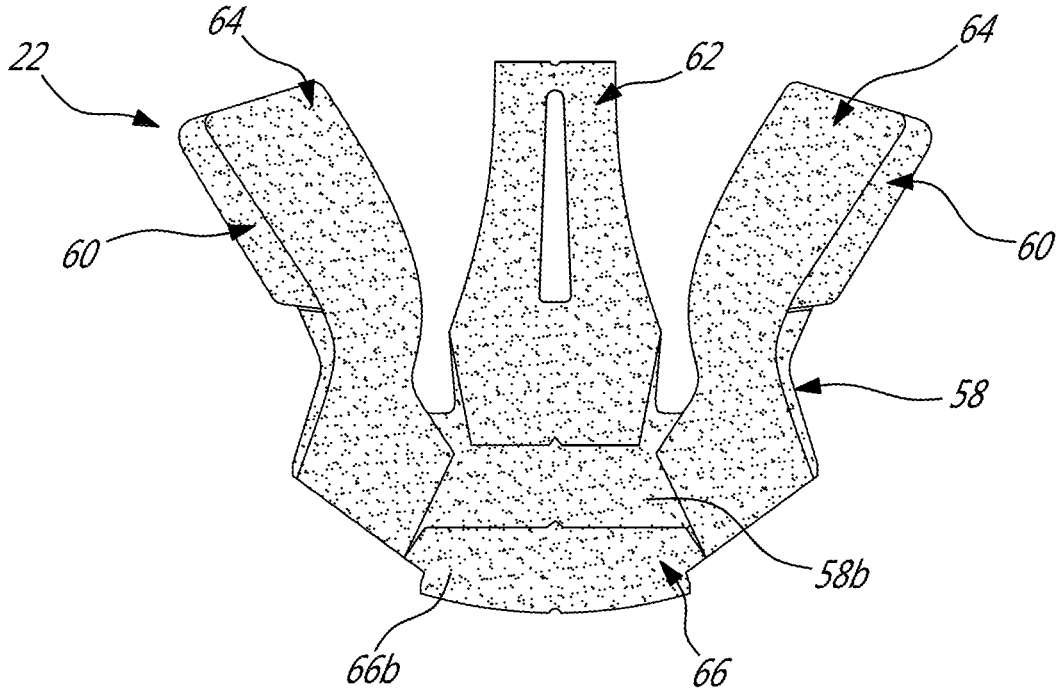

Referring to FIGS. 13*a*-13*b*, the upper front assembly 22 further includes an outer central pad 66 which is connected to the outer surface of the intermediate central pad 58. The outer central pad 66 extends over most of the base 58*b* of the intermediate central pad 58, and extends downwardly therefrom so that a bottom part 66*b* of the inner surface of the outer central pad 66 is exposed (see FIG. 13*b*).

Figure 14A:
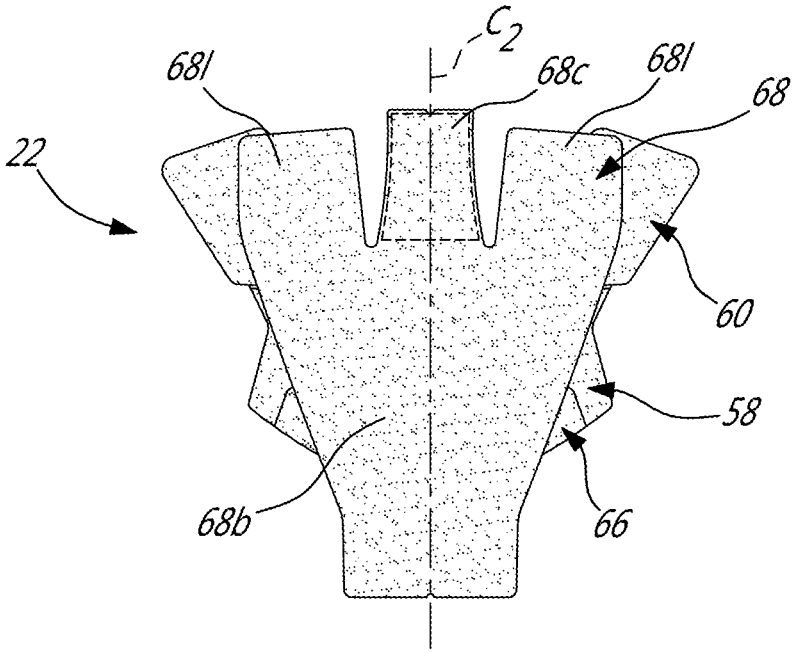
FIGS. 14*a*-14*b* are schematic outer and inner views, respectively, of the assembly of FIGS. 13*a*-13*b* to which a front connecting pad has been added so as to define the upper front assembly in accordance with a particular embodiment.
Figure 14B:
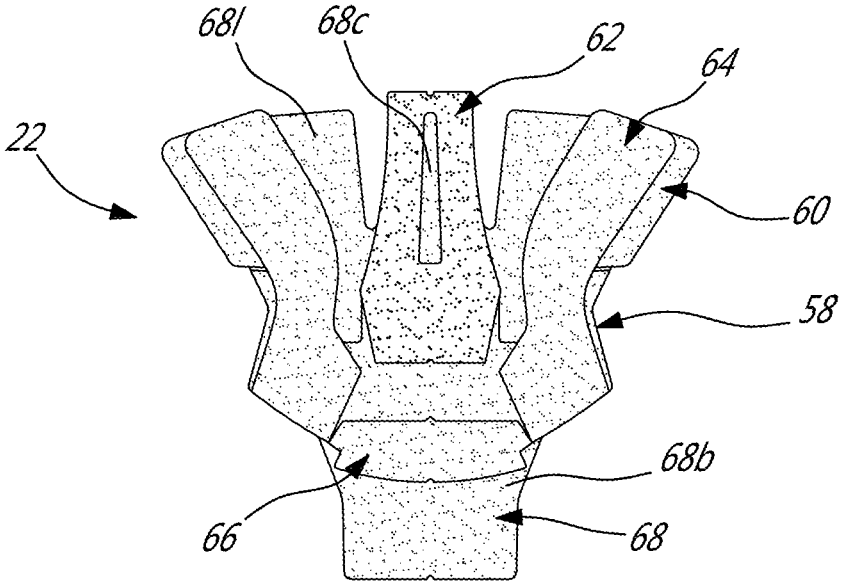

Referring to FIG. 14*a*, the upper front assembly 22 further includes a front connecting pad 68. The front connecting pad 68 includes a base 68*b*, a central portion 68*c* extending upwardly from the base along the central axis $C_2$, and two legs 68*l* extending upwardly from the base 68*b* on a respective side of the central portion 68*c*. Referring to FIG. 14*b*, the base 68*b* overlaps the outer surface of the intermediate central and lateral pads 58, 60 and the outer surface of the outer central pad 66, without being directly connected thereto. The inner surface of the central portion 68*c* of the front connecting pad 68 is connected to the outer surface of the intermediate central pad 58, for example using a suitable adhesive. Each leg 68*l* of the front connecting pad 68 overlaps the outer surface of the respective intermediate lateral pad 60 without being directly connected thereto. The legs 68*l* of the front connecting pad 68 extend across part of the gap separating the inner central and lateral pads 62, 64; the front connecting pad 68 is movable with respect to most of the upper front assembly 22, since it is connected thereto only along the central portion 68*c*. The base 68*b* of the front connecting pad 68 extends downwardly from the outer central part so that a bottom part of the inner surface of the base 68*b* of the front connecting pad 68 is exposed. The front connecting pad 68 is sufficiently flexible to conform to the rounded shape of the inner surface of the outer shell 12.

A particular embodiment of the lower front assembly 24 is shown in FIGS. 15 to 18*b*. It is however understood that the configuration shown and described herein is exemplary only, that any other suitable configuration and number of pads may alternately be used, and that the pads may have any other suitable shape.

Figure 15:
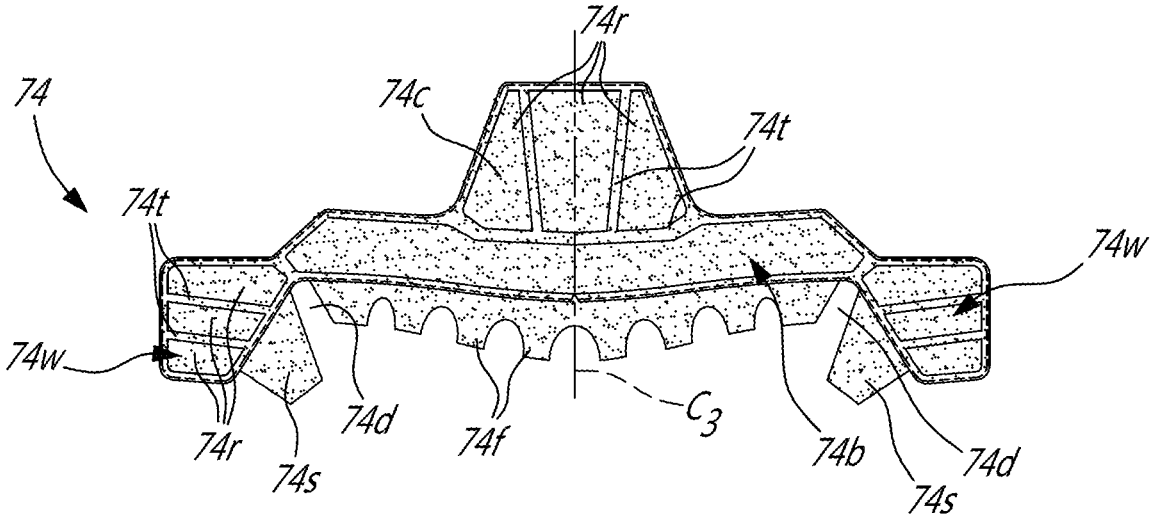
FIG. 15 is a schematic inner view of an inner frontal pad of the liner assembly of FIG. 2 in accordance with a particular embodiment.

The lower front assembly 24 generally includes an outer frontal pad 70, an intermediate frontal pad 72, and an inner frontal pad 74. Referring to FIG. 15, the inner frontal pad 74 is molded such that its inner surface includes a plurality of thicker raised sections 74*r* which are spaced apart by linear thinner recessed sections 74*t*. In the embodiment shown, the inner frontal pad 74 includes an elongated base 74*b* having a substantially trapezoid shape, a central portion 74*c* extending upwardly from the base 74*b* along its central axis $C_3$, and two wings 74*w* each extending from a respective side of the base 74*b* The central portion 74*c* has a trapezoidal shape and includes triangular raised sections 74*r* separated by linear recessed sections 74*t*, with a perimeter of the central portion 74*c*, including a junction between the central portion 74*c* and the base 74*b*, also being defined by recessed sections 74*t*. The wings 74*w* each have a truncated triangular shape and include raised sections 74*r* separated by linear recessed sections 74*t*, with a perimeter of the wings 74*w* also being defined by recessed sections 74*t*. The top of the base 74*b* is defined by a raised section 74*r*, while the remainder of the base 74*b*, including the part connected to the wings 74*w*, has a constant thickness corresponding to that of the recessed sections 74*t*. The base 74*b* includes two diagonal cuts or notches 74*d* separating a bottom part of the base 74*b* into side portions 74*s* each connected to a respective wing, and a central section defining fingers 74*f* and extending downwardly from the raised section 74*r* of the base 74*b*.

Figure 16:
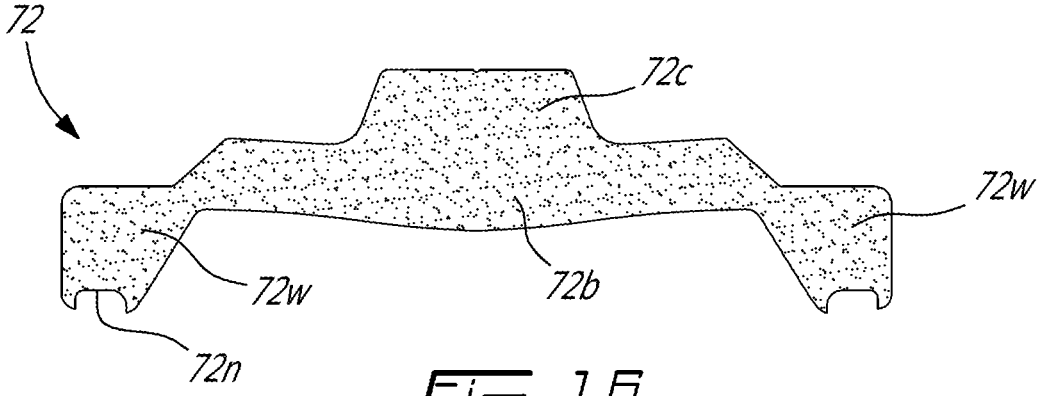
FIG. 16 is a schematic inner view of an intermediate frontal pad of the liner assembly of FIG. 2 in accordance with a particular embodiment.

Referring to FIG. 16, the intermediate frontal pad 72 includes a base 72*b* having a shape similar to an upper part of the base 74*b* of the inner frontal pad 74, a central portion 72*c* extending upwardly from the base 72*b*, having a width similar to that of the central portion 74*c* of the inner frontal pad 74 but a shorter height, and two wings 72*w* extending from a respective side of the base 72*b*, shaped similarly to the wings 74*w* of the inner frontal pad 74. The bottom edge of each of the wings 72*w* includes a small notch 72*n* defined therethrough.

Figure 17:
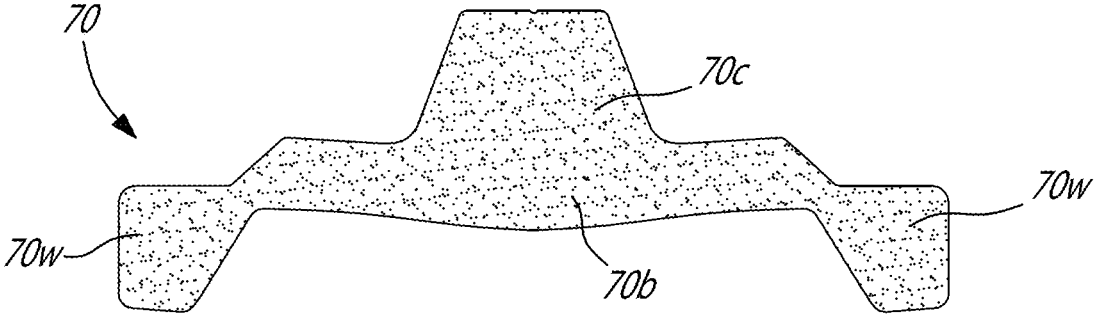
FIG. 17 is a schematic inner view of an outer frontal pad of the liner assembly of FIG. 2 in accordance with a particular embodiment.

Referring to FIG. 17, the outer frontal pad 70 includes a base 70*b* having a shape similar to the base 72*b* of the intermediate frontal pad 72, a central portion 70*c* extending upwardly from the base 70*b* and having a shape similar to that of the central portion 74*c* of the inner frontal pad 74, and two wings 70*w* extending from a respective side of the base 70*b*, shaped similarly to the wings 74*w* of the inner frontal pad 74.

Figure 18A:
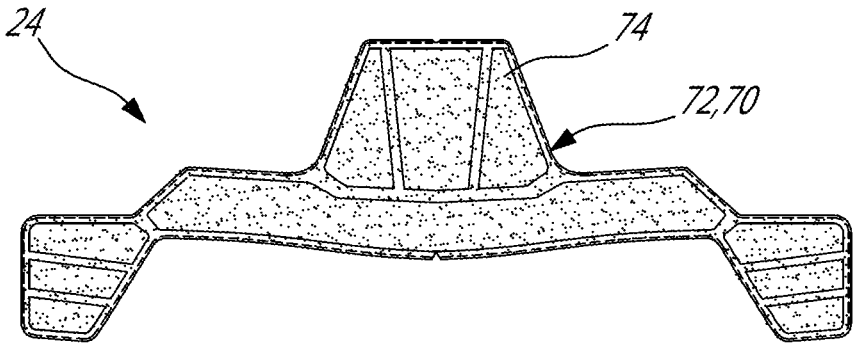
FIGS. 18*a*-18*b* are schematic outer and inner views, respectively, of a lower front assembly including the frontal pads of FIGS. 15-17.
Figure 18B:
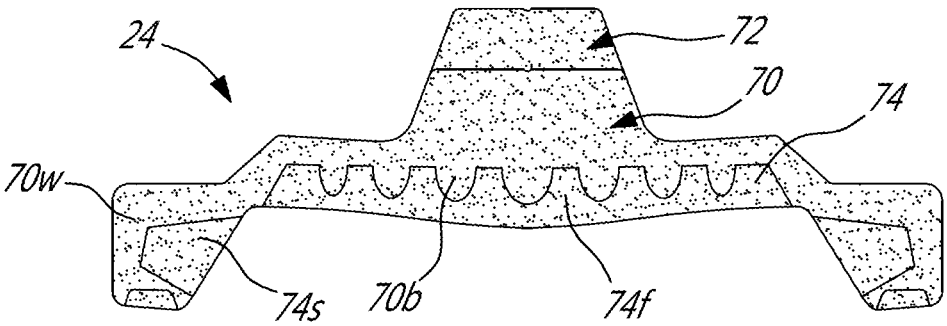

Referring to FIGS. 18*a*-18*b*, the inner surface of the outer frontal pad 70 is connected to the outer surface of the intermediate frontal pad 72 and the inner surface of the intermediate frontal pad 72 is connected to the outer surface of the inner frontal pad 74, for example by a suitable adhesive or a lamination process. As can be seen in FIG. 18*b*, the bottom part of the base 74*b* of the inner frontal pad 74 is folded and "wrapped" around the bottom edges of the intermediate and outer frontal pads 72, 70, so that the fingers 74*f* are connected to the outer surface of the base 70*b* of the outer frontal pad 70, and the side portions 74*s* are connected to outer surface of the wings 70*w* of the outer frontal pad 70.

Figure 19A:
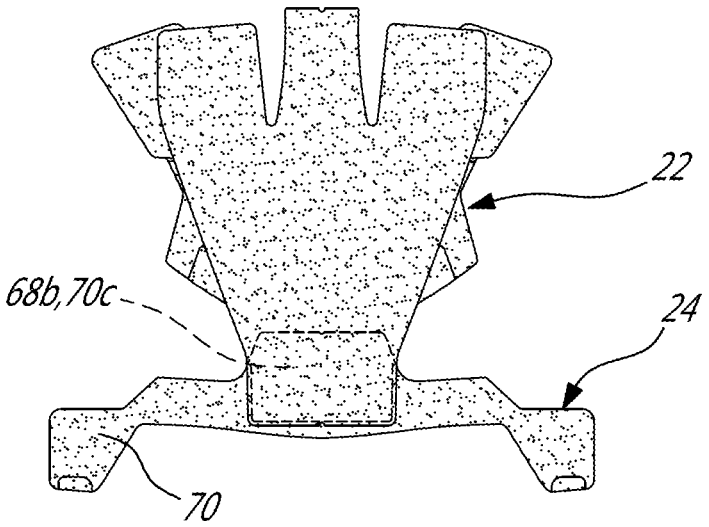
FIGS. 19*a*-19*b* are schematic outer and inner views, respectively, of the upper front assembly of FIGS. 14*a*-14*b* connected to the lower front assembly of FIGS. 18*a*-18*b*, in accordance with a particular embodiment.
Figure 19B:
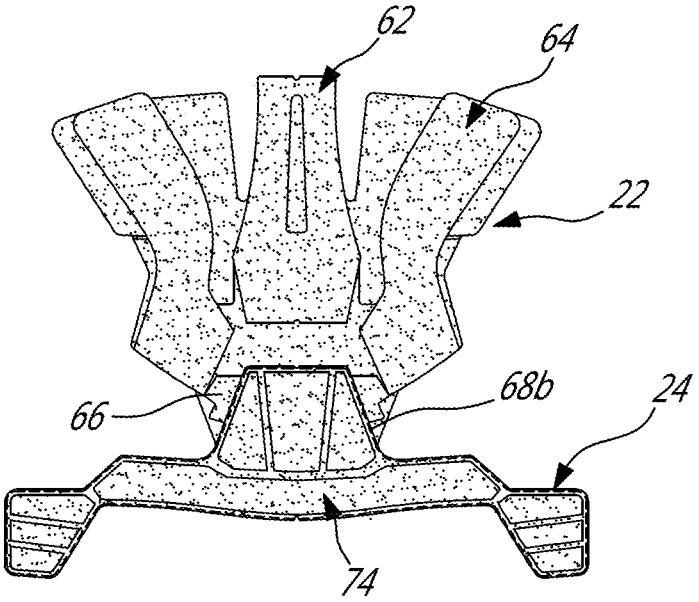

Referring to FIG. 19*a*, the upper and lower front assemblies 22, 24 are interconnected. The inner surface of the central portion 70*c* of the outer frontal pad 70 is connected to the exposed inner surface of the base 68*b* of the front connecting pad 68, for example using a suitable adhesive. Referring to FIG. 19*b*, the lower front assembly 24 overlaps the outer frontal pad 66 without being connected thereto.

Since the lower front assembly 24 is only connected to a relatively small portion of the front connecting pad 70, the upper and lower front assemblies 22, 24 are movable relative to one another. Referring to FIG. 2, the inner surfaces of the inner central pad 62, of the inner lateral pads 64, and of the inner frontal pad 74 are visible in the interior of the helmet 10 when the liner assembly 16 and outer shell 12 are interconnected, and disposed in close proximity to one another due to deformation of the underlying pads.

Figure 20A:
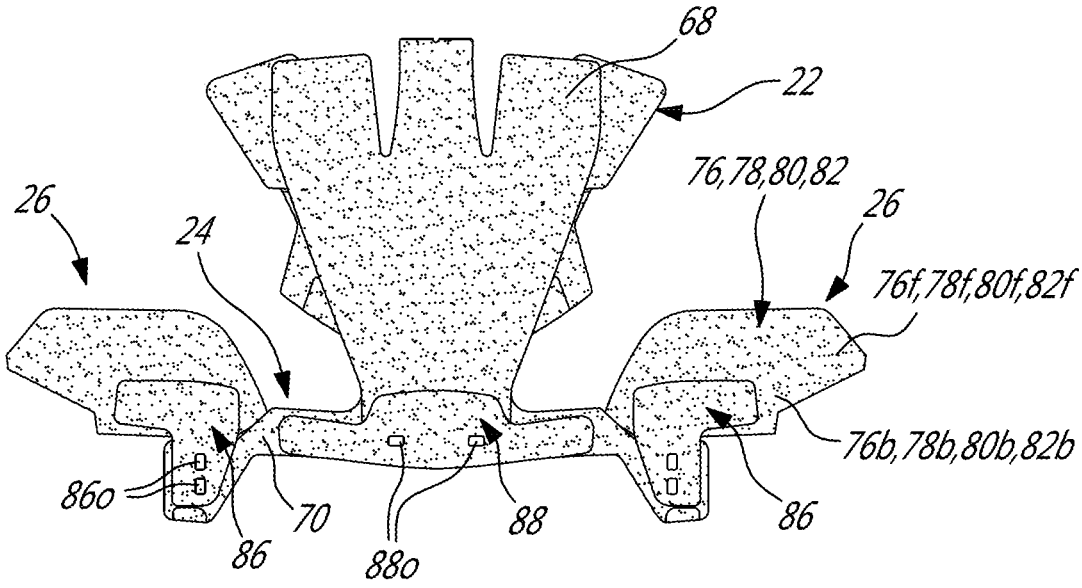
FIGS. 20*a*-20*b* are schematic outer and inner views, respectively, of the assembly of FIGS. 19*a*-19*b* to which side assemblies have been connected, in accordance with a particular embodiment.
Figure 20B:
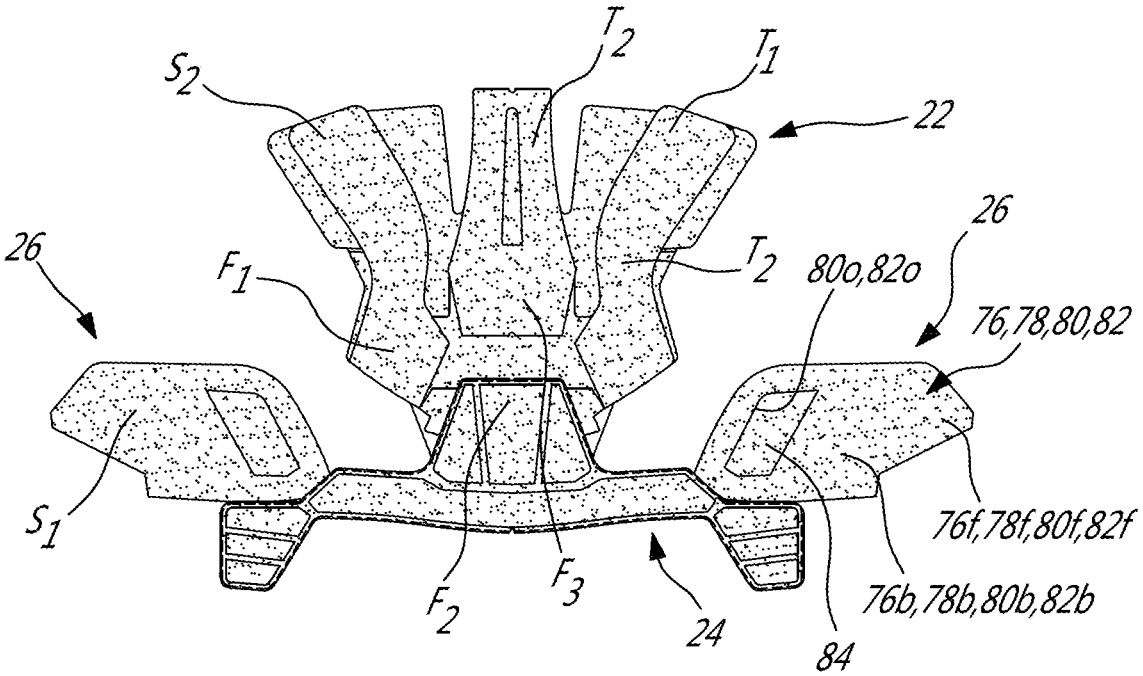

A particular embodiment of the side assemblies 26 is shown in FIGS. 20*a*-20*b*. It is however understood that the configuration shown and described herein is exemplary only, that any other suitable configuration and number of pads may alternately be used, and that the pads may have any other suitable shape.

Each side assembly 26 includes an outer side pad 76, first and second intermediate side pads 78, 80, and an inner side pad 82. Referring to FIG. 20*a*, the outer side pad 76 has a base 76*b* with a truncated triangular shape, and a finger 76*f* extending laterally from the base 76*b*. The first intermediate side pad 78 is connected to an inner surface of the outer side pad 76, the second intermediate side pad 80 is connected to an inner surface of the first intermediate side pad 78, and the inner side pad 82 is connected to an inner surface of the second intermediate side pad 80. The first intermediate side pad 78, second intermediate side pad 80 and inner side pad 82 all have a shape similar to that of the outer side pad 76, with a base 78*b*, 80*b*, 82*b* from which extends a finger 78*f*, 80*f*, 82*f*. The second intermediate side pad 80 and the inner side pad 82 each have a similar opening 80*o*, 82*o* defined therethrough, with the openings 80*o*, 82*o* being aligned with each other; a complementary shaped insert pad 84 is received in the aligned openings 80*o*, 82*o*. In a particular embodiment, the complementary shaped insert pad 84 is made of rate sensitive material, for example as set forth above. Other types of materials (e.g. foam) may alternately be used. In another particular embodiment, the openings 80*o*, 82*o* in the second intermediate and inner side pads 80, 82 and the complementary shaped insert pad 84 are omitted.

Referring to FIG. 20*a*, each side assembly 26 is connected to the lower front assembly 24 by a respective L-shaped connecting piece 86 made for example of fabric (e.g. a suitable grade of polyester), which is connected to the outer surfaces of the outer side pad 76 and of the outer frontal pad 70 by a suitable adhesive. A central connecting piece 88, made for example of fabric (e.g. a suitable grade of polyester), is also connected to the outer surfaces of the front connecting pad 68 and of the outer frontal pad 70 by a suitable adhesive. Each connecting piece 86, 88 includes openings 86*o*, 88*o* defined therethrough. The upper front assembly 22, lower front assembly 24 and side assemblies 26, which are connected to each other, are connected to the outer shell 12 by fasteners (not shown) inserted to and engaged with the openings 86*o*, 88*o*, for example a respective screw extending through each opening 86*o*, 88*o* and connected to the outer shell 12, and retained to the respective connecting piece 86, 88 by a respective nut (not shown). Referring to FIG. 2, the inner surface of the inner side pad 82 is visible in the interior of the helmet 10 when the liner assembly 16 and outer shell 12 are interconnected, and disposed adjacent the inner central pad 62 due to the deformation of the lower front assembly 24 conforming to the curve of the outer shell 12.

The pads of the liner assembly 16 may be made of any suitable material, for example any suitable type of foam, and may be formed using any adequate method, including, but not limited to, die cutting and molding. In a particular embodiment, the pads of the liner assembly 16 are each made of a selected one of four materials, for example foam materials, having different densities and/or hardness from one other, so as to form layers of different materials overlapping one another in critical regions of the liner assembly 16. In a particular embodiment, the liner assembly 16 includes some or all of the zones provided in Table 1 below, where the layers are positioned in order from the outer shell 12 to the head of user, i.e. where layer 1 is located outwardly of layers 2, 3 and 4, layer 2 is located outwardly of layers 3 and 4, and layer 3 is located outwardly of layer 4. In the embodiment shown, the layers of Table 1 are located immediately adjacent one another, so as to be in contact with the adjacent layer(s) during use, i.e. layer 2 contacts layers 1 and 3 on its opposite sides, and layer 3 contacts layers 2 and 4 on its opposite sides.

The zones F1, F2 and F3 are located in the front portion 16*f* of the liner assembly 16, the zones R1 and R2 are located in the rear portion 16*r* of the liner assembly 16, the zones S1 and S2 are located in the side portions 16*s* of the liner assembly 16, and the zones T1 and T2 are located in the top portion 16*t* of the liner assembly 16. FIGS. 2, 11*c* and 20*b* show exemplary locations for each of the zones. Accordingly, in the embodiment shown the layers of each zone are defined by the particular pads set forth in Table 1 below.

TABLE 1

Examples of zones of the liner assembly of the embodiment shown

| Zone | Layers from outer shell to head | Pad | Material |
|---|---|---|---|
| F1 | Layer 1 | Front connecting pad 68 | Second material |
| | Layer 2 | Outer central pad 66 | Third material |
| | Layer 3 | Intermediate central pad 58 | Second material |
| | Layer 4 | Inner lateral pad 64 | Third material |
| F2 | Layer 1 | Front pad 30 of band + front connecting pad 68 | Second material |
| | Layer 2 | Outer central pad 66 + outer frontal pad 70 + intermediate frontal pad 72 | Third material |
| | Layer 3 | Inner frontal pad 74 | Fourth material |
| F3 | Layer 1 | Front connecting pad 68 + intermediate central pad 58 | Second material |
| | Layer 2 | Inner central pad 62 | Third material |
| R1 | Layer 1 | Outer and inner rear pads 36, 38 of band | Second material |
| | Layer 2 | Rear connecting pad 54 | First material |
| | Layer 3 | Outer and intermediate rear pads 50, 48 | Second material |
| | Layer 4 | Inner read pad 46 | Fourth material |
| R2 | Layer 1 | Outer and inner rear pads 36, 38 of band | Second material |
| | Layer 2 | Rear connecting pad 54 | First material |
| | Layer 3 | Outer occipital pad 42 | Third material |
| | Layer 4 | Inner occipital pad 44 | Fourth material |
| S1 | Layer 1 | First or second side pad of band 32, 34 | Second material |
| | Layer 2 | Outer side pad 76 | First material |
| | Layer 3 | First intermediate side pad 78 | Third material |
| | Layer 4 | Second intermediate side pad 80 + inner side pad 82 | Fourth material |
| S2 | Layer 1 | Front connecting pad 68 | Second material |
| | Layer 2 | Intermediate lateral pad 60 + inner lateral pad 64 | Third material |
| T1 | Layer 1 | Front connecting pad 68 | Second material |
| | Layer 2 | Intermediate lateral pad 60 + inner lateral pad 64 | Third material |
| T2 | Layer 1 | Front connecting pad 68 + intermediate central pad 58 | Second material |
| | Layer 2 | Inner central pad 64 | Third material |

In a particular embodiment, the first material has a greater density and hardness than the second, third and fourth materials, the second material has a greater density and hardness than the third and fourth materials, and the third material has a greater density and hardness than the fourth material.

It is understood that the layer and material configuration set forth in Table 1 is applicable to any other suitable liner assembly including pads having different shapes than that shown in the Figures.

In a particular embodiment, the materials listed in Table 1 correspond to the materials set forth in Table 2 below:

TABLE 2

Materials in accordance with a particular embodiment

| | Type of material | Density range ($g/cm^3$) | Hardness (Shore 00) Range | Hardness (Shore 00) Particular value |
|---|---|---|---|---|
| First material | vinyl nitrile foam | 0.17 to 0.21 | 75 to 95 | 80 |
| Second material | vinyl nitrile foam | 0.11 to 0.14 | 65 to 85 | 75 |
| Third material | vinyl nitrile foam | 0.09 to 0.12 | 55 to 75 | 70 |
| Fourth material | Ethylene-vinyl acetate (EVA) foam | 0.09 to 0.12 | 35 to 75 | 45 |

It is understood that the materials provided are exemplary only, and that other suitable materials can alternately be used. As a non-limiting example, other types of materials having a density and/or hardness corresponding to the range set forth in the tables may alternately be used. Other suitable materials include expanded foam such as for example expanded polypropylene (EPP), expanded polyethylene (EPE) or expanded polystyrene (EPS).

In a particular embodiment, where the pads may be configured as per the embodiment shown and/or as per the configuration set forth in Table 1 or according to any other suitable configuration, the liner assembly includes one or more of the zones provided in Table 3 below, where a major part or a whole of each of the layers has at least the thickness set forth in the table. It is understood that the zones set forth in Table 3 also apply to any other suitable configuration of liner assembly different from that shown and described herein.

TABLE 3

Zones of liner assembly in accordance with a particular embodiment

| Zone | Layers from outer shell to head | Thickness (mm) | Material |
|---|---|---|---|
| F1 | Layer 1 | 4 | Second material |
| | Layer 2 | 6 | Third material |
| | Layer 3 | 10 | Second material |
| | Layer 4 | 8 | Third material |
| F2 | Layer 1 | 10 | Second material |
| | Layer 2 | 20 | Third material |
| | Layer 3 | 8 | Fourth material |
| F3 | Layer 1 | 14 | Second material |
| | Layer 2 | 8 | Third material |
| R1 | Layer 1 | 8 | Second material |
| | Layer 2 | 2 | First material |
| | Layer 3 | 16 | Second material |
| | Layer 4 | 4 | Fourth material |
| R2 | Layer 1 | 8 | Second material |
| | Layer 2 | 2 | First material |
| | Layer 3 | 12 | Third material |

TABLE 3-continued

Zones of liner assembly in accordance with a particular embodiment

| Zone | Layers from outer shell to head | Thickness (mm) | Material |
|---|---|---|---|
| | Layer 4 | 8 | Fourth material |
| S1 | Layer 1 | 6 | Second material |
| | Layer 2 | 4 | First material |
| | Layer 3 | 10 | Third material |
| | Layer 4 | 8 | Fourth material |
| S2 | Layer 1 | 4 | Second material |
| | Layer 2 | 23 | Third material |
| T1 | Layer 1 | 4 | Second material |
| | Layer 2 | 23 | Third material |
| T2 | Layer 1 | 14 | Second material |
| | Layer 2 | 8 | Third material |

In a particular embodiment, the liner assembly is configured so that the front portion **16*f* includes at least one of the zones F1, F2 and F3, the rear portion 16*r* includes at least one of the zones R1 and R2, the side portions 16*s* include at least one of the zones S1 and S2, and the top portion 16*t* includes at least one of the zones T1 and T2** as set forth in Table 3. In a particular embodiment, the liner assembly includes all of the zones listed in Table 3. It is understood that the zones set forth in Table 3 may be located differently than that shown in the figures and may be applicable to liner assemblies having configurations different from that shown. As in the example of Table 1, each layer in Table 3 may be formed by a single sheet of material (i.e. single pad) or by two of more sheets of the same material overlapping each other, as defined by different pads.

It is understood that the thickness of the layers may be variable; in a particular embodiment, the thickness provided in Table 3 is a minimum thickness applicable to raised sections of the layer forming the major part of the layer, and the raised sections may be separated by recessed sections having a smaller thickness than the value provided in the table, for example 1 mm. For examples, where one of the layers is defined in whole or in part by a pad configured similarly to the inner frontal pad 74 or to the inner occipital pad 44, the thickness listed in Table 3 refers to a minimum thickness of the raised sections.

It is understood that the layers may have a thickness greater than that listed in Table 3. For example, in a particular embodiment, some or all of the layers have a thickness having a value of at least 25% more than the values set forth in Table 3.

In another particular embodiment, the layers of the liner assembly are thinner than the thickness values set forth in Table 3. In a particular embodiment, where the pads may be configured as per the embodiment shown and/or as per the configuration set forth in Table 1 or according to any other suitable configuration, the liner assembly includes one or more of the zones provided in Table 4 below, where a major part or a whole of each of the layers has at least the thickness set forth in the table. It is understood that the zones set forth in Table 4 also apply to any other suitable configuration of liner assembly different from that shown and described herein.

TABLE 4

| Zones of the liner assembly in accordance with another particular embodiment | | | |
|---|---|---|---|
| Zone | Layers from outer shell to head | Thickness (mm) | Material |
| F1 | Layer 1 | 3.2 | Second material |
| | Layer 2 | 4.8 | Third material |
| | Layer 3 | 8 | Second material |
| | Layer 4 | 6.4 | Third material |
| F2 | Layer 1 | 8 | Second material |
| | Layer 2 | 16 | Third material |
| | Layer 3 | 6.4 | Fourth material |
| F3 | Layer 1 | 11.2 | Second material |
| | Layer 2 | 6.4 | Third material |
| R1 | Layer 1 | 6.4 | Second material |
| | Layer 2 | 1.6 | First material |
| | Layer 3 | 12.8 | Second material |
| | Layer 4 | 3.2 | Fourth material |
| R2 | Layer 1 | 6.4 | Second material |
| | Layer 2 | 1.6 | First material |
| | Layer 3 | 9.6 | Third material |
| | Layer 4 | 6.4 | Fourth material |
| S1 | Layer 1 | 4.8 | Second material |
| | Layer 2 | 3.2 | First material |
| | Layer 3 | 8 | Third material |
| | Layer 4 | 6.4 | Fourth material |
| S2 | Layer 1 | 3.2 | Second material |
| | Layer 2 | 18.4 | Third material |
| T1 | Layer 1 | 3.2 | Second material |
| | Layer 2 | 18.4 | Third material |
| T2 | Layer 1 | 11.2 | Second material |
| | Layer 2 | 6.4 | Third material |

In a particular embodiment, the liner assembly is configured so that the front portion 16*f* includes at least one of the zones F1, F2 and F3, the rear portion 16*r* includes at least one of the zones R1 and R2, the side portions 16*s* include at least one of the zones S1 and S2, and the top portion 16*t* includes at least one of the zones T1 and T2 as set forth in Table 4. In a particular embodiment, the liner assembly includes all of the zones listed in Table 4. It is understood that the zones set forth in Table 4 may be located differently than that shown in the figures and may be applicable to liner assemblies having configurations different from that shown. As in the examples of Table 1 and Table 3, each layer in Table 4 may be formed by a single sheet of material (i.e. single pad) or by two of more sheets of the same material overlapping each other, as defined by different pads.

As for Table 3, in a particular embodiment, the thickness provided in Table 4 is a minimum thickness applicable to raised sections of the layer defining a major part of the layer, and the raised sections may be separated by recessed sections having a smaller thickness than the value provided in the table, for example 1 mm. For examples, where one of the layers is defined in whole or in part by a pad configured similarly to the inner frontal pad 74 or to the inner occipital pad 44, the thickness listed in Table 4 refers to a minimum thickness of the raised sections.

In a particular embodiment, the materials of Tables 3 and 4 correspond to the type of material, density and/or hardness set forth in Table 2 above. In another embodiment, the materials of Tables 3 and 4 are in part or in whole different from that listed in Table 2, but the first material has a greater density and/or hardness than the second, third and fourth materials, the second material has a greater density and/or hardness than the third and fourth materials, and the third material has a greater density and/or hardness than the fourth material.

In a particular embodiment, the layers of Tables 3 and 4 are located immediately adjacent one another, so as to be in contact with the adjacent layer(s) during use, i.e. layer 2 contacts layers 1 and 3 on its opposite sides, and layer 3 contacts layers 2 and 4 on its opposite sides. Alternately, intermediate layer(s) may be provided.

In a particular embodiment where the liner assembly includes one or more of the zones set forth in Table 3 or in Table 4 for each of the front, rear, side and top portions of the liner assembly, the helmet is particularly suitable to attenuate the impact severity experienced during testing in accordance with Virginia Tech's Hockey STAR testing methodology and rating.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A protective helmet comprising:

an outer shell; and a liner assembly received in the outer shell and connected to the outer shell, the liner assembly defining a front portion configured to overlay a front of a head of a wearer, a rear portion configured to overlay a rear of the head of the wearer, a top portion configured to be disposed above a top of the head of the wearer when the helmet is worn, and two opposed side portions each configured to overlay a respective side of the head of the wearer;

wherein each of the front, rear, side and top portions includes at least one zone where the liner assembly includes overlapping layers, each of the layers being made from one of first, second, third, and fourth materials; and wherein:

the at least one zone of the front portion has a configuration defined by one of a first front zone (F1), a second front zone (F2) and a third front zone (F3), wherein the first front zone (F1), the second front zone (F2) and the third front zone (F3) are respectively composed as follows:

| Zone | Layers from outer shell to head | Minimum Thickness (mm) | Material |
|---|---|---|---|
| First front zone (F1) | Layer 1 | 3.2 | Second material |
| | Layer 2 | 4.8 | Third material |
| | Layer 3 | 8 | Second material |
| | Layer 4 | 6.4 | Third material |
| Second front zone (F2) | Layer 1 | 8 | Second material |
| | Layer 2 | 16 | Third material |
| | Layer 3 | 6.4 | Fourth material |
| Third front zone (F3) | Layer 1 | 11.2 | Second material |
| | Layer 2 | 6.4 | Third material, |

the at least one zone of the rear portion has a configuration defined by one of a first rear zone (R1) and a second rear zone (R2), wherein the first rear zone (R1) and the second rear zone (R2) are respectively composed as follows:

| Zone | Layers from outer shell to head | Minimum Thickness (mm) | Material |
|---|---|---|---|
| First rear zone (R1) | Layer 1 | 6.4 | Second material |
| | Layer 2 | 1.6 | First material |
| | Layer 3 | 12.8 | Second material |
| | Layer 4 | 3.2 | Fourth material |
| Second rear zone (R2) | Layer 1 | 6.4 | Second material |
| | Layer 2 | 1.6 | First material |
| | Layer 3 | 9.6 | Third material |
| | Layer 4 | 6.4 | Fourth material, |

the at least one zone of the side portions has a configuration defined by one of a first side zone (S1) and a second side zone (S2), wherein the first side zone (S1) and the second side zone (S2) are respectively composed as follows:

| Zone | Layers from outer shell to head | Minimum Thickness (mm) | Material |
|---|---|---|---|
| First side zone (S1) | Layer 1 | 4.8 | Second material |
| | Layer 2 | 3.2 | First material |
| | Layer 3 | 8 | Third material |
| | Layer 4 | 6.4 | Fourth material |
| Second side zone (S2) | Layer 1 | 3.2 | Second material |
| | Layer 2 | 18.4 | Third material, |

and the at least one zone of the top portion has a configuration defined by one of a first top zone (T1) and a second top zone (T2), wherein the first top zone (T1) and the second top zone (T2) are respectively composed as follows:

| Zone | Layers from outer shell to head | Minimum Thickness (mm) | Material |
|---|---|---|---|
| First top zone (T1) | Layer 1 | 3.2 | Second material |
| | Layer 2 | 18.4 | Third material |
| Second top zone (T2) | Layer 1 | 11.2 | Second material |
| | Layer 2 | 6.4 | Third material |

wherein the first material has a greater hardness than that of the second, third and fourth materials, the second material has a greater hardness than that of the third and fourth materials, and the third material has a greater hardness than that of the fourth material.

2. The protective helmet of claim 1, wherein the front portion includes each of the first front zone (F1), the second front zone (F2), and the third front zone (F3).

3. The protective helmet of claim 1, wherein the rear portion includes both of the first rear zone (R1) and the second rear zone (R2).

4. The protective helmet as defined in claim 1, wherein the side portions includes both of the first side zone (S1) and the second side zone (S2).

5. The protective helmet as defined in claim 1, wherein the top portion includes both of the first top zone (T1) and the second top zone (T2) .

6. The protective helmet as defined in claim 1, wherein the respective thickness of each of the layers of the at least one of the first front zone (F1), the second front zone (F2), and the third front zone (F3), of the at least one the first rear zone (R1) and the second rear zone (R2), of the at least one of the first side zone (S1) and the second side zone (S2), and of the at least one of the first top zone (T1) and the second top zone (T2) corresponds to at least the thickness set forth in Table 3.

7. The protective helmet as defined in claim 1, wherein the first material is a vinyl nitrile foam, the second material is a vinyl nitrile foam, the third material is a vinyl nitrile foam, and the fourth material is an Ethylene-vinyl acetate (EVA) foam.

8. The protective helmet as defined in claim 1, wherein the first material is a vinyl nitrile foam with a density of from 0.17 to 0.21 g/cm3, the second material is a vinyl nitrile foam with a density of from 0.11 to 0.14 g/cm3, the third material is a vinyl nitrile foam with a density of from 0.09 to 0.12 g/cm3, and the fourth material is an Ethylene-vinyl acetate (EVA) foam with a density of from 0.09 to 0.12 g/cm3.

9. The protective helmet as defined in claim 1, wherein the first material is a vinyl nitrile foam with a density of from 0.17 to 0.21 g/cm3 and a Shore Hardness of from 75 to 95, the second material is a vinyl nitrile foam with a density of from 0.11 to 0.14 g/cm3 and a Shore Hardness of from 65 to 85, the third material is a vinyl nitrile foam with a density of from 0.09 to 0.12 g/cm3 and a Shore Hardness of from 55 to 75, and the fourth material is an Ethylene-vinyl acetate (EVA) foam with a density of from 0.09 to 0.12 g/cm3 and a Shore Hardness of from 35 to 75.

10. A protective helmet comprising:

an outer shell; and a liner assembly received in the outer shell and connected to the outer shell, the liner assembly defining a front portion configured to overlay a front of a head of a wearer, a rear portion configured to overlay a rear of the head of the wearer, a top portion configured to be above the head of the wearer when the helmet is worn, and two opposed side portions each configured to overlay a respective side of the head of the wearer; and wherein the front portion includes at least two layers and has a configuration defined by one of a first front zone (F1), a second front zone (F2) or a third front zone (F3), and the rear portion includes four layers and has a configuration defined by one of a first rear zone (R1) or a second rear zone (R2);

wherein the first front zone (F1), the second front zone (F2) and the third front zone (F3) of the front portion are respectively composed of two or more of the layers each having a minimum thickness and made of one of first, second, third and fourth materials as follows:

| Zone | Layers from outer shell to head | Minimum Thickness (mm) | Material |
|---|---|---|---|
| First front zone (F1) | Layer 1 | 3.2 | Second material |
| | Layer 2 | 4.8 | Third material |
| | Layer 3 | 8 | Second material |
| | Layer 4 | 6.4 | Third material |
| Second front zone (F3) | Layer 1 | 8 | Second material |
| | Layer 2 | 16 | Third material |
| | Layer 3 | 6.4 | Fourth material |
| Third front zone (F3) | Layer 1 | 11.2 | Second material |
| | Layer 2 | 6.4 | Third material |

wherein the first rear zone (R1) and the second rear zone (R2) of the rear portion are respectively composed of four layers each having a minimum thickness and made of the one of first, second, third and fourth materials as follows:

| Zone | Layers from outer shell to head | Minimum Thickness (mm) | Material |
|---|---|---|---|
| First | Layer 1 | 6.4 | Second material |
| rear | Layer 2 | 1.6 | First material |
| zone | Layer 3 | 12.8 | Second material |
| (R1) | Layer 4 | 3.2 | Fourth material |
| Second | Layer 1 | 6.4 | Second material |
| rear | Layer 2 | 1.6 | First material |
| zone | Layer 3 | 9.6 | Third material |
| (R2) | Layer 4 | 6.4 | Fourth material |

wherein the first material has a qreater hardness than that of the second, third and fourth materials, the second material has a greater hardness than that of the third and fourth materials, and the third materias a greater hardness than that of the fourth material.

* * * * *